US006413330B1

(12) United States Patent
Oishi

(10) Patent No.: US 6,413,330 B1
(45) Date of Patent: Jul. 2, 2002

(54) LEAD-FREE FREE-CUTTING COPPER ALLOYS

(75) Inventor: Keiichiro Oishi, Sakai (JP)

(73) Assignee: Sambo Copper Alloy Co., Ltd., Sakai (JP)

( * ) Notice: Subject to any disclaimer, the term of this patent is extended or adjusted under 35 U.S.C. 154(b) by 0 days.

(21) Appl. No.: 09/987,173

(22) Filed: Nov. 13, 2001

Related U.S. Application Data

(63) Continuation-in-part of application No. 09/555,881, filed as application No. PCT/JP98/05157 on Nov. 16, 1998.

(30) Foreign Application Priority Data

Oct. 12, 1998 (JP) ..... 10-288590

(51) Int. Cl.[7] ..... C22C 9/04; C22F 1/08

(52) U.S. Cl. ..... 148/434; 420/477; 420/479; 420/480; 420/481; 420/482; 420/483

(58) Field of Search ..... 148/434; 420/477, 420/479, 480, 481, 482, 483

(56) References Cited

U.S. PATENT DOCUMENTS 5,487,867 A * 1/1996 Singh ..... 420/471

FOREIGN PATENT DOCUMENTS

JP 62274036 * 11/1987
JP 03068731 * 3/1991

* cited by examiner

*Primary Examiner*—Sikyin Ip
(74) *Attorney, Agent, or Firm*—Griffin & Szipl, P.C.

(57) ABSTRACT

A lead-free free-cutting copper alloy having 69 to 79 percent, by weight, of copper; greater than 3 percent, by weight, of silicon; and a remaining percent, by weight, of zinc. The alloy preferable has greater than 3.0 percent and less than or equal to 4.0 percent, by weight, of silicon; and at least one element selected from among 0.02 to 0.4 percent, by weight, of bismuth, 0.02 to 0.4 percent, by weight, of tellurium, and 0.02 to 0.4 percent, by weight, of selenium. The alloy also preferable has at least one element selected from among 0.3 to 3.5 percent, by weight, of tin, 1.0 to 3.5 percent, by weight, of aluminum, and 0.02 to 0.25 percent, by weight, of phosphorus. In further embodiments, the alloy has at least one element selected from among 0.02 to 0.15 percent, by weight, of antimony, and 0.02 to 0.15 percent, by weight, of arsenic.

12 Claims, 1 Drawing Sheet

LEAD-FREE FREE-CUTTING COPPER ALLOYS

This application is a continuation-in-part of U.S. patent application Ser. No. 09/555,881, filed Jun. 8, 2000, the entire disclosure of which is incorporated herein by reference, which is a 371 of PCT/JP98/05157 filed Nov. 16, 1998 which application claims priority from Japanese Application No. 10-288590, filed Oct. 12, 1998, the entire disclosure of which is incorporated herein by reference.

BACKGROUND OF THE INVENTION

1. Field of the Invention

The present invention relates to lead-free free-cutting copper alloys.

2. Prior Art

Among the copper alloys with a good machinability are bronze alloys such as that having the JIS designation H5111 BC6 and brass alloys such as those having the JIS designations H3250-C3604 and C3771. These alloys are enhanced in machinability by the addition of 1.0 to 6.0 percent, by weight, of lead, and provide an industrially satisfactory machinability. Because of their excellent machinability, those lead-contained copper alloys have been an important basic material for a variety of articles such as city water faucets, water supply/drainage metal fittings and valves.

However, the application of those lead-mixed alloys has been greatly limited in recent years, because lead contained therein is an environmental pollutant harmful to humans. That is, the lead-contained alloys pose a threat to human health and environmental hygiene because lead is contained in metallic vapor that is generated in the steps of processing those alloys at high temperatures, such as in melting and casting operations. There is also a concern that lead contained in water system metal fittings, valves, and other components made of those alloys will dissolve out into drinking water.

For these reasons, the United States and other advanced countries have been moving to tighten the standards for lead-contained copper alloys, drastically limiting the permissible level of lead in copper alloys in recent years. In Japan, too, the use of lead-contained alloys has been increasingly restricted, and there has been a growing call for development of free-cutting copper alloys with a low lead content.

SUMMARY OF THE INVENTION

It is an object of the present invention to provide a lead-free copper alloy which does not contain the machinability-improving element lead, yet is quite excellent in machinability and can be used as safe substitute for the conventional free cutting (easy-to-cut) copper alloy that has a high lead content, with concomitant environmental hygienic problems. The lead-free copper alloy of the present invention also permits recycling of chips without problems. Thus, the present invention presents a timely answer to the mounting call for restriction of lead-containing products.

It is an another object of the present invention to provide a lead-free copper alloy that has high corrosion resistance as well as excellent machinability, and is suitable as basic material for cutting works, forgings, castings, and other applications, thus having a very high practical value. The cutting works, forgings, castings, and other applications include city water faucets, water supply/drainage metal fittings, valves, stems, hot water supply pipe fittings, shaft and heat exchanger parts.

It is yet another object of the present invention to provide a lead-free copper alloy with high strength and wear resistance as well as machinability. This lead-free copper alloy is suitable as basic material for the manufacture of cutting works, forgings, castings, and other uses requiring high strength and wear resistance such as, for example, bearings, bolts, nuts, bushes, gears, sewing machine parts, and hydraulic system parts. Hence, this embodiment of the present invention has a very high practical value.

It is a further object of the present invention to provide a lead-free copper alloy with excellent high-temperature oxidation resistance as well as machinability, which alloy is suitable as basic material for the manufacture of cutting works, forgings, castings, and other uses where high thermal oxidation resistance is essential, e.g., nozzles for kerosene oil and gas heaters, burner heads, and gas nozzles for hot-water dispensers. Hence, this embodiment of the present invention too has a very high practical value.

The objects of the present inventions are achieved by provision of the following copper alloys:

A lead-free free-cutting copper alloy with an excellent machinability, which is composed of 69 to 79 percent, by weight, of copper, more than 3.0 to 4.0 percent or less, by weight, of silicon, and the remaining percent, by weight, of zinc, wherein the percent by weight of copper and silicon in the copper alloy satisfy the relationship; $55 \leqq X-3Y \leqq 70$, wherein X is the percent, by weight, of copper, and Y is the percent, by weight, of silicon; and the copper alloy has a metal construction comprising multiple phases integrated to form a composite phase, wherein the composite phase is an $\alpha$ phase matrix having a total phase area comprising not more than 5% of a $\beta$ phase, and 5–70% of the total phase area is provided by at least one phase selected from the group consisting of a $\gamma$ phase, a $\kappa$ phase, and a $\mu$ phase. For purpose of simplicity, this copper alloy will be hereinafter called the "first invention alloy".

Lead does not form a solid solution in the matrix but instead disperses in a granular form to improve the machinability of an alloy. Silicon enhances the easy-to-cut property of an alloy by producing a gamma phase (in some cases, a kappa phase) in the structure of metal. That way, both act to improve alloy machinability, though they are quite different in their respective contributions to the properties of the alloy. On the basis of that recognition, silicon is added to the first invention alloy in place of lead so as to bring about a high level of machinability meeting industrial requirements. That is, the first invention alloy is improved in machinability through formation of a gamma phase with the addition of silicon.

The addition of less than 2.0 percent, by weight, of silicon cannot form a gamma phase sufficient to provide industrially satisfactory machinability. With increases above 2.0 weight-percent in the addition of silicon, the machinability improves. But with the addition of more than 4.0 percent, by weight, of silicon, the machinability will not improve proportionally. A problem is, however, that silicon has a high melting point and a low specific gravity and is also liable to oxidize. If silicon alone is fed in a simple substance into a furnace in an alloy melting step, silicon will float on the molten metal and be oxidized into oxides of silicon (or silicon oxide), hampering production of a silicon-containing copper alloy. In making an ingot of silicon-containing copper alloy, therefore, silicon is usually added in the form of a Cu—Si alloy, which boosts the production cost. In the light of the cost of making the alloy, too, it is not desirable to add silicon in a quantity exceeding the saturation point where machinability improvement levels off, i.e., 4.0 percent by weight. Experimentation has shown that when silicon is added in an amount of more than 3.0 percent and up to and including 4.0 percent, by weight, it is desirable to hold the content of copper to 69 to 79 percent, by weight, in consideration of its relation to the content of zinc in order to maintain the intrinsic properties of the Cu—Zn alloy. For this reason, the first invention alloy is composed of 69 to 79 percent, by weight, of copper and more than 3.0 percent and up to and including 4.0 percent, by weight, of silicon. It is stressed that the range of silicon content included, by weight, in the composition of the first invention alloy excludes 3 percent, by weight, of silicon. The addition of silicon, as specified above, improves not only the machinability but also the flow of the molten metal in casting, strength, wear resistance, resistance to stress corrosion cracking, high-temperature oxidation resistance. Also, the ductility and dezincification resistance will be improved to some extent.

A lead-free free-cutting copper alloy, also with an excellent machinability, which is composed of 69 to 79 percent, by weight, of copper; 2.0 to 4.0 percent, by weight, of silicon; at least one element selected from among 0.02 to 0.4 percent, by weight, of bismuth, 0.02 to 0.4 percent, by weight, of tellurium, and 0.02 to 0.4 percent, by weight, of selenium; and the remaining percent, by weight, of zinc, wherein the percent by weight of copper and silicon in the copper alloy satisfy the relationship; $55 \leqq X-3Y \leqq 70$, wherein X is the percent, by weight, of copper, and Y is the percent, by weight, of silicon; and the copper alloy has a metal construction comprising multiple phases integrated to form a composite phase, wherein the composite phase is an $\alpha$ phase matrix having a total phase area comprising not more than 5% of a $\beta$ phase, and 5–70% of the total phase area is provided by at least one phase selected from the group consisting of a $\gamma$ phase, a $\kappa$ phase, and a $\mu$ phase. This second copper alloy will be hereinafter called the "second invention alloy."

That is, the second invention alloy is composed of the first invention alloy and at least one element selected from among 0.02 to 0.4 percent, by weight, of bismuth, 0.02 to 0.4 percent, by weight, of tellurium, and 0.02 to 0.4 percent, by weight, of selenium.

Bismuth, tellurium, and selenium, like lead, do not form a solid solution in the matrix but disperse in granular form to enhance machinability through a mechanism different from that of silicon. Hence, the addition of those elements along with silicon could further improve the machinability beyond the level obtained by the addition of silicon alone. From this finding, the second invention alloy is provided in which at least one element selected from among bismuth, tellurium, and selenium is mixed to further improve the machinability obtained by the first invention alloy. The addition of bismuth, tellurium, or selenium in addition to silicon produces a high machinability such that complicated forms can be freely cut at a high speed. But no improvement in machinability can be realized from the addition of bismuth, tellurium, or selenium in an amount less than 0.02 percent, by weight. However, those elements are expensive as compared with copper. Even if the addition exceeds 0.4 percent by weight, the proportional improvement in machinability is so small that the addition beyond that does not pay economically. What is more, if the addition is more than 0.4 percent by weight, the alloy will deteriorate in hot workability such as forgeability and cold workability such as ductility. While there might be a concern that heavy metals like bismuth would cause problems similar to those of lead, addition of a very small amount of less than 0.4 percent by weight is negligible and would present no particular problems. Based upon these considerations, the second invention alloy is prepared with the addition of bismuth, tellurium, or selenium kept to 0.02 to 0.4 percent by weight. The addition of those elements, which positively affect the machinability of the copper alloy though a mechanism different from that of silicon, as mentioned above, would not affect the proper contents of copper and silicon. On this ground, the contents of copper and silicon in the second invention alloy are set at the same level as those in the first invention alloy.

A lead-free free-cutting copper alloy that also has excellent machinability which is composed of 70 to 80 percent, by weight, of copper; 1.8 to 3.5 percent, by weight, of silicon; at least one element selected from among 0.3 to 3.5 percent, by weight, of tin, and 0.02 to 0.25 percent, by weight, of phosphorus; and the remaining percent, by weight, of zinc, wherein the percent by weight of copper, silicon, tin and phosphorus in the copper alloy satisfy the relationship; $55 \leqq X-3Y+aZ+bW \leqq 70$, wherein X is the percent, by weight, of copper, Y is the percent, by weight, of silicon, Z is the percent, by weight, of tin, W is the percent, by weight, of phosphorus, a is −0.5, and b is −3; and the copper alloy has a metal construction comprising multiple phases integrated to form a composite phase, wherein the composite phase is an $\alpha$ phase matrix having a total phase area comprising not more than 5% of a $\beta$ phase, and 5–70% of the total phase area is provided by at least one phase selected from the group consisting of a $\gamma$ phase, a $\kappa$ phase, and a $\mu$ phase. This third copper alloy will be hereinafter called the "third invention alloy."

Tin works the same way as silicon. That is, if tin is added to the Cu—Zn alloy, a gamma phase will be formed and the machinability of the Cu—Zn alloy will be improved. For example, the addition of tin in an amount of 1.8 to 4.0 percent by weight would bring about a high machinability in the Cu—Zn alloy containing 58 to 70 percent, by weight, of copper; even if silicon is not added. Therefore, the addition of tin to the Cu—Si—Zn alloy can facilitate the formation of a gamma phase and further improve the machinability of the Cu—Si—Zn alloy. The gamma phase is formed with the addition of tin in an amount of 1.0 or more percent by weight, and gamma phase formation reaches the saturation point at 3.5 percent, by weight, of tin. If tin exceeds 3.5 percent by weight, the ductility will drop instead. With the addition of tin in amounts less than 1.0 percent by weight, on the other hand, no gamma phase will be formed. If the addition is 0.3 percent or more by weight, then tin will be effective in uniformly dispersing the gamma phase formed by silicon. Machinability is improved through that effect of dispersing the gamma phase. In other words, the addition of tin in amounts of not less than 0.3 percent by weight improves the machinability of the alloy.

As for phosphorus, it has no property of forming the gamma phase as in the case of tin. However, phosphorus works to uniformly disperse and distribute the gamma phase formed as a result of the addition of silicon alone or with tin. In that way, improvement in machinability through gamma phase formation is further enhanced. In addition to dispersing the gamma phase, phosphorus helps to refine the crystal grains in the alpha phase in the matrix, improving hot workability and also strength and resistance to stress corrosion cracking. Furthermore, phosphorus substantially increases the flow of molten metal in casting. To produce such results, phosphorus will have to be added in an amount not smaller than 0.02 percent by weight. But if the addition exceeds 0.25 percent by weight, no proportional effect is obtained. Instead, there will be a decrease in hot forging properties and in extrudability.

In consideration of those observations, the third invention alloy is improved in machinability by adding to the Cu—Si—Zn alloy at least one element selected from among 0.3 to 3.5 percent, by weight, of tin, and 0.02 to 0.25 percent, by weight, of phosphorus.

Meanwhile, tin and phosphorus serve to improve the machinability by forming a gamma phase or dispersing that phase, and work closely with silicon in promoting the improvement in machinability through the gamma phase. In the third invention alloy mixed with silicon along with tin or phosphorus, therefore, silicon does not work alone. Machinability is improved not only by the silicon, but by tin or phosphorus, and thus the required addition of silicon is smaller than that in the second invention alloy in which the machinability is enhanced by adding bismuth, tellurium, or selenium. That is, those elements bismuth, tellurium, and selenium contribute to improving the machinability, not by acting on the gamma phase but by dispersing in the form of grains in the matrix. Even if the addition of silicon is less than 2.0 percent by weight, silicon along with tin or phosphorus will be able to enhance the machinability to an industrially satisfactory level as long as the percentage of silicon is 1.8 or more percent by weight. But even if the addition of silicon is not larger than 4.0 percent by weight, the effect of silicon in improving machinability is saturated and is not promoted any further in the cases where tin or phosphorus is added, when the silicon content exceeds 3.5 percent by weight. For this reason, the addition of silicon is set at 1.8 to 3.5 percent by weight in the third invention alloy. Also, in consideration of the added amount of silicon and also the addition of tin or phosphorus, the content range of copper in this third invention alloy is slightly raised from the level in the second invention alloy and is set at 70 to 80 percent by weight as preferred content of copper.

A lead-free free-cutting copper alloy also with an excellent easy-to-cut (i.e., machinability) feature which is composed of 70 to 80 percent, by weight, of copper; 1.8 to 3.5 percent, by weight, of silicon; at least one element selected from among 0.3 to 3.5 percent, by weight, of tin and 0.02 to 0.25 percent, by weight, of phosphorus; at least one element selected from among 0.02 to 0.4 percent, by weight, of bismuth, 0.02 to 0.4 percent, by weight, of tellurium, and 0.02 to 0.4 percent, by weight, of selenium; and the remaining percent, by weight, of zinc, wherein the percent by weight of copper, silicon, tin and phosphorus in the copper alloy satisfy the relationship; $55 \leqq X-3Y+aZ+bW \leqq 70$, wherein X is the percent, by weight, of copper, Y is the percent, by weight, of silicon, Z is the percent, by weight, of tin, W is the percent, by weight, of phosphorus, a is −0.5, and b is −3; and the copper alloy has a metal construction comprising multiple phases integrated to form a composite phase, wherein the composite phase is an α phase matrix having a total phase area comprising not more than 5% of a β phase, and 5–70% of the total phase area is provided by at least one phase selected from the group consisting of a γ phase, a κ phase, and a μ phase. This fourth copper alloy will be hereinafter called the "fourth invention alloy."

The fourth invention alloy thus contains at least one element selected from among 0.02 to 0.4 percent, by weight, of bismuth, 0.02 to 0.4 percent, by weight, of tellurium, and 0.02 to 0.4 percent, by weight, of selenium, in addition to the components in the third invention alloy. The grounds for adding those additional elements and setting the amounts to be added are the same as given for the second invention alloy.

A lead-free free-cutting copper alloy having excellent machinability and exhibiting a high degree of corrosion resistance, which is composed of 69 to 79 percent, by weight, of copper; 2.0 to 4.0 percent, by weight, of silicon; at least one element selected from among 0.3 to 3.5 percent, by weight, of tin and 0.02 to 0.25 percent, by weight, of phosphorus, at least one element selected from among 0.02 to 0.15 percent, by weight, of antimony, and 0.02 to 0.15 percent, by weight, of arsenic, and the remaining percent, by weight, of zinc, wherein the percent by weight of copper, silicon, tin and phosphorus in the copper alloy satisfy the relationship; $55 \leqq X-3Y+aZ+bW \leqq 70$, wherein X is the percent, by weight, of copper, Y is the percent, by weight, of silicon, Z is the percent, by weight, of tin, W is the percent, by weight, of phosphorus, a is −0.5, and b is −3; and the copper alloy has a metal construction comprising multiple phases integrated to form a composite phase, wherein the composite phase is an α phase matrix having a total phase area comprising not more than 5% of a β phase, and 5–70% of the total phase area is provided by at least one phase selected from the group consisting of a γ phase, a κ phase, and a μ phase. This fifth copper alloy will be hereinafter called the "fifth invention alloy."

The fifth invention alloy thus contains at least one element selected from among 0.3 to 3.5 percent, by weight, of tin and 0.02 to 0.25 percent, by weight, of phosphorus, at least one element selected from among 0.02 to 0.15 percent, by weight, of antimony, and 0.02 to 0.15 percent, by weight, of arsenic, in addition to the first invention alloy.

Tin is effective in improving not only the machinability but also the corrosion resistance properties (dezincification resistance and erosion corrosion resistance) and forgeability of the alloy. In other words, tin improves the corrosion resistance in the alpha phase matrix and, by dispersing the gamma phase, the corrosion resistance, forgeability, and stress corrosion cracking resistance. The fifth invention alloy is thus improved in corrosion resistance by such property of tin and in machinability mainly by adding silicon. Therefore, the contents of silicon and copper in this alloy are set at the same as those in the first invention alloy. To raise the corrosion resistance and forgeability, on the other hand, tin would have to be added in an amount of at least 0.3 percent by weight. But even if the addition of tin exceeds 3.5 percent by weight, the corrosion resistance and forgeability will not improve in proportion to the added amount of tin. The addition of amounts of tin in excess of 3.5 percent by weight is, therefore, uneconomical.

As described above, phosphorus disperses the gamma phase uniformly and at the same time refines the crystal grains in the alpha phase in the matrix, thereby improving the machinability and also the corrosion resistance properties (dezincification resistance and erosion corrosion resistance), forgeability, stress corrosion cracking resistance, and mechanical strength. The fifth invention alloy is thus improved in corrosion resistance and other properties by such properties of phosphorus and in machinability mainly by adding silicon. The addition of phosphorus in a very small quantity; that is, 0.02 or more percent by weight can produce beneficial results. But the addition in an amount of more than 0.25 percent by weight would not produce proportional benefits, and instead would reduce hot forgeability and extrudability.

Just as with phosphorus, antimony and arsenic in a very small quantities −0.02 or more percent by weight—are effective in improving the dezincification resistance and other properties. But their addition in amounts exceeding 0.15 percent by weight would not produce results in proportion to the quantity mixed. Instead, it would lower the hot forgeability and extrudability, as would phosphorus applied in excessive amounts.

Those observations indicate that the fifth invention alloy is improved in machinability and also corrosion resistance and other properties by adding at least one element selected from among tin and phosphorus, and by adding at least one element selected from among antimony and arsenic, in quantities within the aforesaid limits, in addition to the same quantities of copper and silicon as in the first invention copper alloy. In the fifth invention alloy, the additions of copper and silicon are set at 69 to 79 percent by weight and 2.0 to 4.0 percent by weight respectively—the same level as in the first invention alloy in which any other machinability improver than silicon is not added—because tin and phosphorus work mainly as corrosion resistance improvers like antimony and arsenic.

A lead-free free-cutting copper alloy, also with excellent machinability and with high corrosion resistance, which is composed of 69 to 79 percent, by weight, of copper; 2.0 to 4.0 percent, by weight, of silicon; at least one element selected from among 0.3 to 3.5 percent, by weight, of tin and 0.02 to 0.25 percent, by weight, of phosphorus, at least one element selected from among 0.02 to 0.15 percent, by weight, of antimony, and 0.02 to 0.15 percent, by weight, of arsenic; at least one element selected from among 0.02 to 0.4 percent, by weight, of bismuth, 0.02 to 0.4 percent, by weight, of tellurium, and 0.02 to 0.4 percent, by weight, of selenium; and the remaining percent, by weight, of zinc, wherein the percent by weight of copper, silicon, tin and phosphorus in the copper alloy satisfy the relationship; $55 \leqq X-3Y+aZ+bW \leqq 70$, wherein X is the percent, by weight, of copper, Y is the percent, by weight, of silicon, Z is the percent, by weight, of tin, W is the percent, by weight, of phosphorus, a is −0.5, and b is −3; and the copper alloy has a metal construction comprising multiple phases integrated to form a composite phase, wherein the composite phase is an α phase matrix having a total phase area comprising not more than 5% of a β phase, and 5–70% of the total phase area is provided by at least one phase selected from the group consisting of a γ phase, a κ phase, and a $\mu$ phase. This sixth copper alloy will be hereinafter called the "sixth invention alloy."

The sixth invention alloy thus contains at least one element selected from among 0.02 to 0.4 percent, by weight, of bismuth, 0.02 to 0.4 percent, by weight, of tellurium, and 0.02 to 0.4 percent, by weight, of selenium, in addition to the components in the fifth invention alloy. The machinability of the alloy is improved by adding silicon and at least one element selected from among bismuth, tellurium, and selenium as in the second invention alloy and the corrosion resistance and other properties are raised by using at least one element selected from among tin, phosphorus, antimony, and arsenic as in the fifth invention alloy. Therefore, the additions of copper, silicon, bismuth, tellurium, and selenium are set at the same levels as those in the second invention alloy, while the contents of tin, phosphorus, antimony, and arsenic are adjusted to the levels of the same elements in the fifth invention alloy.

A lead-free free-cutting copper alloy, also with excellent machinability and with excellent high strength features and high corrosion resistance, which is composed of 62 to 78 percent, by weight, of copper; 2.5 to 4.5 percent, by weight, of silicon; at least one element selected from among 0.3 to 3.0 percent, by weight, of tin and 0.02 to 0.25 percent, by weight, of phosphorus; and at least one element selected from among 0.7 to 3.5 percent, by weight, of manganese and 0.7 to 3.5 percent, by weight, of nickel; and the remaining percent, by weight, of zinc, wherein the percent by weight of copper, silicon, tin, phosphorus, manganese and nickel in the copper alloy satisfy the relationship; $55 \leqq X-3Y+aZ+bW+cV+dU \leqq 70$, wherein X is the percent, by weight, of copper, Y is the percent, by weight, of silicon, Z is the percent, by weight, of tin, W is the percent, by weight, of phosphorus, V is the percent, by weight, of manganese, U is the percent, by weight, of nickel, a is −0.5, b is −3, c is 2.5, d is 2.5, and the percent by weith of silicon, manganese and nickel satisfy the relationship; $0.7 \leqq Y/(V+U) \leqq 6$; and the copper alloy has a metal construction comprising multiple phases integrated to form a composite phase, wherein the composite phase is an α phase matrix having a total phase area comprising not more than 5% of a β phase, and 5–70% of the total phase area is provided by at least one phase selected from the group consisting of a γ phase, a κ phase, and a $\mu$ phase. The seventh copper alloy will be hereinafter called the "seventh invention alloy."

Manganese and nickel combine with silicon to form intermetallic compounds, which may be represented by the formulas $Mn_xSi_y$ or $Ni_xSi_y$, which intermetallic compounds are evenly precipitated in the matrix, thereby raising the wear resistance and strength of the alloy containing them. Thus the addition of manganese and/or nickel improves high strength features and wear resistance. Improved effects are exhibited when manganese and nickel are added in amounts not less than 0.7 percent by weight, respectively. But the saturation state is reached at 3.5 percent by weight, and even if the addition is increased beyond that, no proportional results will be obtained. The addition of silicon is set at 2.5 to 4.5 percent by weight to match the addition of manganese or nickel, taking into consideration the consumption to form intermetallic compounds with those elements.

It is also noted that tin and phosphorus help to reinforce the alpha phase in the matrix, thereby improving strength, wear resistance, and also machinability. Tin and phosphorus disperse the alpha and gamma phases, by which the strength, wear resistance, and machinability are improved. Tin in an amount of 0.3 or more percent by weight is effective in improving the strength and machinability. However, if the addition exceeds 3.0 percent by weight, ductility will decrease. For this reason, the addition of tin is set at 0.3 to 3.0 percent by weight, to raise the high strength features and wear resistance in the seventh invention alloy and also to enhance the machinability thereof. The addition of phosphorus disperses the gamma phase and at the same time refines the crystal grains in the alpha phase in the matrix, thereby improving hot workability as well as the strength and wear resistance. Furthermore, phosphorus is very effective in improving the flow of molten metal in casting. Such results will be produced when phosphorus is added in the range of 0.02 to 0.25 percent by weight. The content of copper is set at 62 to 78 percent by weight, in view of the addition of silicon and the bonding of silicon with manganese and nickel.

A lead-free free-cutting copper alloy, also with excellent machinability and with excellent high strength features as well as high wear resistance, comprises 62 to 78 percent, by weight, of copper; 2.5 to 4.5 percent, by weight, of silicon; at least one element selected from among 0.3 to 3.0 percent, by weight, of tin and 0.02 to 0.25 percent, by weight, of phosphorus; and at least one element selected from among 0.7 to 3.5 percent, by weight, of manganese and 0.7 to 3.5 percent, by weight, of nickel; at least one element selected from among 0.02 to 0.4 percent, by weight, of bismuth, 0.02 to 0.4 percent, by weight, of tellurium, and 0.02 to 0.4 percent, by weight, of selenium; and the remaining percent, by weight, of zinc, wherein the percent by weight of copper, silicon, tin, phosphorus, manganese and nickel in the copper alloy satisfy the relationship; $55 \leqq X-3Y+aZ+bW+cV+dU \leqq 70$, wherein X is the percent, by weight, of copper, Y is the percent, by weight, of silicon, Z is the percent, by weight, of tin, W is the percent, by weight, of phosphorus, V is the percent, by weight, of manganese, U is the percent, by weight, of nickel, a is −0.5, b is −3, c is 2.5, d is 2.5, and the percent by weith of silicon, manganese and nickel satisfy the relationship; $0.7 \leqq Y/(V+U) \leqq 6$; and the copper alloy has a metal construction comprising multiple phases integrated to form a composite phase, wherein the composite phase is an α phase matrix having a total phase area comprising not more than 5% of β phase, and 5–70% of the total phase area is provided by at least one phase selected from the group consisting of a γ phase, a κ phase, and a μ phase. The eighth copper alloy will be hereinafter called the "eighth invention alloy."

The eighth copper alloy contains at least one element selected from among 0.02 to 0.4 percent, by weight, of bismuth, 0.02 to 0.4 percent, by weight, of tellurium, and 0.02 to 0.4 percent, by weight, of selenium in addition to the components in the seventh invention alloy. While high-strength features and wear resistance as high as in the seventh invention alloy are secured, the eighth invention alloy is further improved in machinability by the addition of at least one element selected among bismuth and other elements which are effective in raising the machinability through a mechanism different from that exhibited by silicon. The reasons for adding machinability improvers such as bismuth and others and deciding on the quantities thereof to be added are the same as those given for the second, fourth, and sixth invention alloys. The grounds for adding the other elements, that is, copper, zinc, tin, manganese, and nickel, and setting the contents thereof, are the same as given for the seventh invention alloy.

A lead-free free-cutting copper alloy also with excellent machinability coupled with a good high-temperature oxidation resistance which is composed of 69 to 79 percent, by weight, of copper; 2.0 to 4.0 percent, by weight, of silicon; 0.1 to 1.5 percent, by weight, of aluminum; 0.02 to 0.25 percent, by weight, of phosphorus; and the remaining percent, by weight, of zinc, wherein the percent by weight of copper, silicon, aluminum and phosphorus in the copper alloy satisfy the relationship; $55 \leqq X-3Y+aZ+bW \leqq 70$, wherein X is the percent, by weight, of copper, Y is the percent, by weight, of silicon, Z is the percent, by weight, of aluminum, W is the percent, by weight, of phosphorus, a is −2, and b is −3; and the copper alloy has a metal construction comprising multiple phases integrated to form a composite phase, wherein the composite phase is an α phase matrix having a total phase area comprising not more than 5% of a β phase, and 5–70% of the total phase area is provided by at least one phase selected from the group consisting of a γ phase, a κ phase, and a μ phase. The ninth copper alloy will be hereinafter called the "ninth invention alloy."

Aluminum is an element which improves the strength, machinability, wear resistance, and also high-temperature oxidation resistance. Silicon, too, has a property of enhancing the machinability, strength, wear resistance, resistance to stress corrosion cracking, and also high-temperature oxidation resistance of an alloy, as mentioned above. Aluminum works to raise the high-temperature oxidation resistance when the aluminum is added in amounts of not less than 0.1 percent by weight, together with silicon. But when increasing the addition of aluminum beyond 1.5 percent by weight, no proportional results can be expected with respect to high-temperature oxidation resistance. For this reason, the addition of aluminum is set at 0.1 to 1.5 percent by weight.

Aluminum is also effective in promoting the formation of the gamma phase. The addition of aluminum together with tin or in place of tin could further improve the machinability of the Cu—Si—Zn alloy. Aluminum is also effective in improving the strength, wear resistance, and high-temperature oxidation resistance as well as the machinability and also in minimizing the specific gravity. If the machinability is to be improved at all, aluminum will have to be added in amounts of at least 1.0 percent by weight.

Phosphorus is added to enhance the flow of molten metal in casting. Phosphorus also works to improve the aforesaid machinability, dezincification resistance, and high-temperature oxidation resistance, in addition to the flow of molten metal. Those effects are exhibited when phosphorus is added in an amount not smaller than 0.02 percent by weight. But even if phosphorus is used in an amount of more than 0.25 percent by weight, it will not result in a proportional increase in effect. For this reason, the addition of phosphorus is set at 0.02 to 0.25 percent by weight.

While silicon is added to improve the machinability of an alloy as mentioned above, it is also capable of increasing the flow of molten metal as is phosphorus. The effect of silicon in improving the flowability of molten metal is exhibited when it is added in an amount not smaller than 2.0 percent by weight. The range of the addition of silicon for improving the flowability of molten metal overlaps that for improvement of the machinability thereof. Taking both of these factors into consideration, the addition of silicon is set in the range 2.0 to 4.0 percent by weight.

A lead-free free-cutting copper alloy also with excellent machinability and good high-temperature oxidation resistance which is composed of 69 to 79 percent, by weight, of copper; 2.0 to 4.0 percent, by weight, of silicon; 0.1 to 1.5 percent, by weight, of aluminum; 0.02 to 0.25 percent, by weight, of phosphorus; at least one element selected from among 0.02 to 0.4 percent, by weight, of chromium and 0.02 to 0.4 percent, by weight, of titanium; and the remaining percent, by weight, of zinc, wherein the percent by weight of copper, silicon, aluminum, phosphorus and chromium in the copper alloy satisfy the relationship; $55 \leqq X-3Y+aZ+bW+cV \leqq 70$, wherein X is the percent, by weight, of copper, Y is the percent, by weight, of silicon, Z is the percent, by weight, of aluminum, W is the percent, by weight, of phosphorus, V is the percent, by weight, of chromium, a is −2, b is −3, c is 2; and the copper alloy has a metal construction comprising multiple phases integrated to form a composite phase, wherein the composite phase is an α phase matrix having a total phase area comprising not more than 5% of a β phase, and 5–70% of the total phase area is provided by at least one phase selected from the group consisting of a γ phase, a κ phase, and a μ phase. The tenth copper alloy will be hereinafter called the "tenth invention alloy."

Chromium and/or titanium are added in order to improve high-temperature oxidation resistance. Good results can be expected especially when they are added together with aluminum to produce a synergistic effect. Those effects are exhibited when the addition is 0.02 percent or more by weight, whether they are used alone or in combination. The saturation point is 0.4 percent by weight. In consideration of these observations, the tenth invention alloy contains at least one element selected from among 0.02 to 0.4 percent by weight of chromium and 0.02 to 0.4 percent by weight of titanium in addition to the components of the ninth invention alloy, and thus is an improvement over the ninth invention alloy with regard to the high- temperature oxidation resistance of the alloy produced.

A lead-free free-cutting copper alloy also with excellent machinability and a good high-temperature oxidation resistance which is composed of 69 to 79 percent, by weight, of copper; 2.0 to 4.0 percent, by weight, of silicon; 0.1 to 1.5 percent, by weight, of aluminum; 0.02 to 0.25 percent, by weight, of phosphorus; at least one element selected from among 0.02 to 0.4 percent, by weight, of bismuth, 0.02 to 0.4 percent, by weight, of tellurium, and 0.02 to 0.4 percent, by weight, of selenium; and the remaining percent, by weight, of zinc, wherein the percent by weight of copper, silicon, tin and phosphorus in the copper alloy satisfy the relationship; $55 \leqq X-3Y+aZ+bW \leqq 70$, wherein X is the percent, by weight, of copper, Y is the percent, by weight, of silicon, Z is the percent, by weight, of aluminum, W is the percent, by weight, of phosphorus, a is −2, and b is −3; and the copper alloy has a metal construction comprising multiple phases integrated to form a composite phase, wherein the composite phase is an $\alpha$ phase matrix having a total phase area comprising not more than 5% of a $\beta$ phase, and 5–70% of the total phase area is provided by at least one phase selected from the group consisting of a $\gamma$ phase, a $\kappa$ phase, and a $\mu$ phase. The eleventh copper alloy will be hereinafter called the "eleventh invention alloy."

The eleventh invention alloy contains at least one element selected from among 0.02 to 0.4 percent, by weight, of bismuth, 0.02 to 0.4 percent, by weight, of tellurium, and 0.02 to 0.4 percent, by weight, of selenium, in addition to the components of the ninth invention alloy. While having as high a high-temperature oxidation resistance as the ninth invention alloy, the eleventh invention alloy is further improved in machinability by the addition of at least one element selected from among bismuth and other elements which are effective in raising machinability through a mechanism other than that exhibited by silicon.

A lead-free free-cutting copper alloy also with excellent machinability and a good high-temperature oxidation resistance which is composed of 69 to 79 percent, by weight, of copper; 2.0 to 4.0 percent, by weight, of silicon; 0.1 to 1.5 percent, by weight, of aluminum; 0.02 to 0.25 percent, by weight, of phosphorus; at least one element selected from among 0.02 to 0.4 percent, by weight, of chromium, and 0.02 to 0.4 percent by weight of titanium; at least one element selected from among 0.02 to 0.4 percent, by weight, of bismuth, 0.02 to 0.4 percent, by weight, of tellurium, and 0.02 to 0.4 percent, by weight, of selenium; and the remaining percent, by weight, of zinc, wherein the percent by weight of copper, silicon, aluminum, phosphorus and chromium in the copper alloy satisfy the relationship; $55 \leqq X \leqq 3Y+aZ+bW+cV \leqq 70$, wherein X is the percent, by weight, of copper, Y is the percent, by weight, of silicon, Z is the percent, by weight, of aluminum, W is the percent, by weight, of phosphorus, V is the percent, by weight, of chromium, a is −2, b is −3, c is 2; and the copper alloy has a metal construction comprising multiple phases integrated to form a composite phase, wherein the composite phase is an $\alpha$ phase matrix having a total phase area comprising not more than 5% of a $\beta$ phase, and 5–70% of the total phase area is provided by at least one phase selected from the group consisting of a $\gamma$ phase, a $\kappa$ phase, and a $\mu$ phase. The twelfth copper alloy will be hereinafter called the "twelfth invention alloy."

The twelfth invention alloy contains, in addition to the components of the tenth invention alloy, at least one element selected from among 0.02 to 0.4 percent, by weight, of bismuth, 0.02 to 0.4 percent, by weight, of tellurium, and 0.02 to 0.4 percent, by weight, of selenium. While as high a high-temperature oxidation resistance as in the tenth invention alloy is obtained, the twelfth invention alloy is further improved in machinability by adding at least one element selected from among bismuth and other elements which are effective in raising the machinability through a mechanism other than that exhibited by silicon.

A lead-free free-cutting copper alloy, also with further improved machinability, is obtained by subjecting any one of the preceding invention alloys to a heat treatment for 30 minutes to 5 hours at a temperature of from 400° C. to 600° C. This thirteenth copper alloy will be hereinafter called the "thirteenth invention alloy."

The first to twelfth invention alloys contain machinability improving elements such as silicon and have an excellent machinability because of the addition of such elements. Of those invention alloys, the alloys with a high copper content which have large amounts of other phases—mainly alloys having a kappa phase percentage greater than the total percentage of their alpha, beta, gamma, and delta phases together—can further improve in machinability in a heat treatment. As a result of the specified heat treatment, the kappa phase turns into a gamma phase. The gamma phase finely disperses and precipitates to further enhance the machinability of the alloy. The present alloys with high copper content are high in ductility of the matrix and low in absolute quantity of gamma phase, and therefore are excellent in cold workability. But in cases where cold working, such as caulking and cutting, are required, the aforesaid heat treatment is very useful.

In other words, among the first to twelfth invention alloys, those which are high in copper content—with gamma phase in small quantities and kappa phase in large quantities—(hereinafter referred to as the "high copper content alloy") undergo a change in phase from the kappa phase to the gamma phase during the heat treatment. As a result, the gamma phase is finely dispersed and precipitated, and the machinability of the alloy is improved. In practice, during the manufacturing process of castings, expanded metals, and hot forgings, the materials are often force-air-cooled or water cooled depending on the forging conditions, productivity after hot working (hot extrusion, hot forging, etc.), working environment, and other factors. In such cases, among the first to twelfth invention alloys, those with a low content of copper (hereinafter called the "low copper content alloy") are rather low in the content of the gamma phase and contain beta phase. During the heat treatment, the beta phase changes into the gamma phase, and the gamma phase is finely dispersed and precipitated, whereby the machinability is improved.

Experiments show that heat treatment is especially effective: with high copper content alloys, where the mixing ratio of copper and silicon to other added elements (except for zinc) A is given as $67 \leqq Cu-3Si+aA$; and with low copper content alloys, where the mixing ratio of copper and silicon to other added elements (except for zinc) A is given as $64 \geqq Cu-3Si+aA$. It is noted that "a" is a coefficient. The coefficient is different depending on the added element A. For example, with tin, a is −0.5; aluminum, −2; phosphorus, −3; antimony, 0; arsenic, 0; manganese, +2.5; and nickel, +2.5.

In accordance with the present invention, heat treatment at a temperature of less than 400° C. is not economical and practical, because the aforesaid phase change will proceed slowly and much time will be needed to obtain satisfactory results. At temperatures over 600° C., on the other hand, the kappa phase will grow or the beta phase will appear, bringing about no improvement in machinability. From a practical viewpoint, therefore, it is contemplated that the heat treatment be performed for 30 minutes to 5 hours at 400° C. to 600° C.

DETAILED DESCRIPTION OF THE PREFERRED EMBODIMENTS

Example 1

Figure 1:
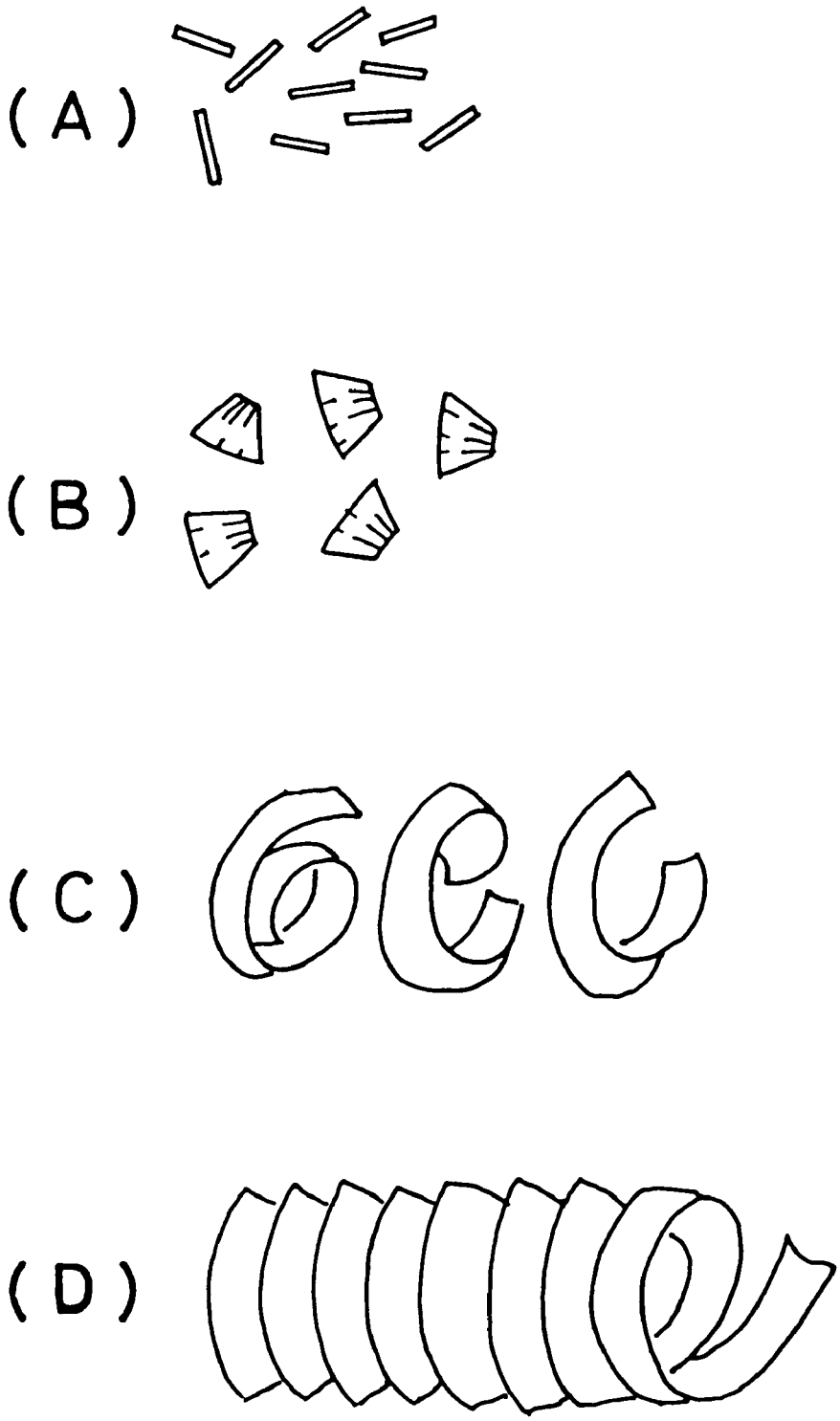
FIG. 1 shows perspective views of cuttings formed in cutting a round bar of copper alloy by lathe.

As the first series of examples of the present invention, cylindrical ingots with compositions given in Tables 1 to 29, each 100 mm in outside diameter and 150 mm in length, were hot extruded into a round bar 15 mm in outside diameter at 750° C. to produce the following test pieces: first invention alloys Nos. 1001 to 1005, second invention alloys Nos. 2001 to 2008, third invention alloys Nos. 3001 to 3012, fourth invention alloys Nos. 4001 to 4035, fifth invention alloys Nos. 5001 to 5020, sixth invention alloys Nos. 6001 to 6105, seventh invention alloys Nos. 7001 to 7030, eighth invention alloys Nos. 8001 to 8147, ninth invention alloys Nos. 9001 to 9005, tenth invention alloys Nos. 10001 to 10008, eleventh invention alloys Nos. 11001 to 11007, and twelfth invention alloys Nos. 12002 to 12021.

Also, cylindrical ingots with the compositions given in Table 30, each 100 mm in outside diameter and 150 mm in length, were hot extruded into a round bar 15 mm in outside diameter at 750° C. to produce the following test pieces: thirteenth invention alloys Nos. 13001 to 13006. That is, No. 13001 is an alloy test piece obtained by heat-treating an extruded test piece with the same composition as first invention alloy No. 1005 for 30 minutes at 580° C. No. 13002 is an alloy test piece obtained by heat-treating an extruded test piece with the same composition as No. 13001 for two hours at 450° C. No. 13003 is an alloy test piece obtained by heat-treating an extruded test piece with the same composition as first invention alloy No.1007 under the same conditions as for No.13001—for 30 minutes at 580° C. No. 13004 is an alloy test piece obtained by heat-treating an extruded test piece with the same composition as No. 13007 under the same conditions as for 13002—for two hours at 450° C. No. 13005 is an alloy test piece obtained by heat-treating an extruded test piece with the same composition as first invention alloy No. 1008 under the same conditions as for No. 13001—for 30 minutes at 580° C. No. 13006 is an alloy test piece obtained by heat-treating an extruded test piece with the same composition as No. 1008 and heat-treated under the same conditions as for 13002—for two hours at 450° C.

As comparative examples from the prior art, cylindrical ingots with the compositions as shown in Table 31, each 100 mm in outside diameter and 150 mm in length, were hot extruded into a round bar 15 mm in outside diameter at 750° C. to obtain the following round extruded test pieces: Nos. 14001 to 14006 (hereinafter referred to as the "conventional alloys"). No.14001 corresponds to the alloy JIS C 3604, No. 14002 to the alloy CDA C 36000, No. 14003 to the alloy JIS C 3771, and No. 14004 to the alloy CDA C 69800. No. 14005 corresponds to the alloy JIS C 6191. This aluminum bronze is the most excellent of those expanded copper alloys having a JIS designation with regard to strength and wear resistance.

To study the machinability of the first to thirteenth invention alloys in comparison with the conventional alloys, cutting tests were carried out. In the cutting tests, evaluations were made on the basis of cutting force, condition of chips, and cut surface condition.

The tests were conducted in this way: The extruded test pieces obtained as described above were cut on the circumferential surface by a lathe mounted with a point noise straight tool at a rake angle of—8 degrees and at a cutting rate of 50 meters/minute, a cutting depth of 1.5 mm, a feed of 0.11 mm/rev. Signals from a three-component dynamometer mounted on the tool were converted into electric voltage signals and recorded on a recorder. From the signals were then calculated the cutting resistance. It is noted that while, to be perfectly exact, an amount of cutting resistance should be judged by three component forces—cutting force, feed force, and thrust force, the judgment was made on the basis of the cutting force (N) of the three component forces in the present example. The results are shown in Table 32 to Table 58.

Furthermore, the chips from the cutting work were examined and classified into four forms (A) to (D) as shown in FIG. 1. The results are enumerated in Table 32 to Table 58. In this regard, the chips in the form of a spiral with three or more windings as (D) in FIG. 1 are difficult to process, that is, recover or recycle, and could cause trouble in cutting work as, for example, getting tangled with the tool and damaging the cut metal surface. Chips in the form of an arc with a half winding to a spiral with about two windings as shown in (C), FIG. 1 do not cause such serious trouble as the chips in the form of a spiral with three or more windings yet are not easy to remove and could get tangled with the tool or damage the cut metal surface. In contrast, chips in the form of a fine needle as (A) in FIG. 1 or in the form of an arc as (B) will not present such problems as mentioned above and are not bulky as the chips in (C) and (D) and easy to process. But fine chips as (A) still could creep into the sliding surfaces of a machine tool such as a lathe and cause mechanical trouble, or could be dangerous because they could stick into the worker's finger, eye, or other body parts. Taking these factors into account, it is appropriate to consider that the chips in (B) are the best, and the second best is the chips in (A). Those in (C) and (D) are not good. In Table 32 to Table 58, the chips judged to be as shown in (B), (A), (C), and (D) are indicated by the symbols "◎", "○", "Δ", and "×", respectively.

In addition, the surface condition of the cut metal surface was checked after cutting work. The results are shown in Table 32 to Table 58. In this regard, the commonly used basis for indication of the surface roughness is the maximum roughness (Rmax). While requirements are different depending on the application field of brass articles, the alloys with Rmax<10 microns are generally considered excellent in machinability. The alloys with 10 microns≦Rmax≦15 microns are judged as industrially acceptable, while those with Rmax≧15 microns are taken as poor in machinability. In Table 32 to Table 57, the alloys with Rmax≦10 microns are marked "○", those with 10 microns≦Rmax≦15 microns are indicated in "Δ" and those with Rmax≧15 microns are represented by a symbol "×".

As is evident from the results of the cutting tests shown in Table 32 to Table 58, the following invention alloys are all equal to the conventional lead-contained alloys Nos. 14001 to 14003 of the prior art in machinability: first invention alloys Nos. 1001 to 1008, second invention alloys Nos. 2001 to 2008, third invention alloys Nos. 3001 to 3012, fourth invention alloys Nos. 4001 to 4035, fifth invention alloys Nos. 5001 to 5020, sixth invention alloys Nos. 6001 to 6105, seventh invention alloys Nos. 7001 to 7030, eighth invention alloys Nos. 8001 to 8147, ninth invention alloys Nos. 9001 to 9005, tenth invention alloys Nos. 10001 to 10008, eleventh invention alloys Nos. 11001 to 11007, and twelfth invention alloys Nos. 12001 to 12021. Especially with regard to formation of the chips, those invention alloys are favorably compared not only with the conventional alloys Nos. 14004 to 14005 with a lead content of not higher than 0.1 percent by weight but also with Nos. 14001 to 14003 which contain large quantities of lead.

Also to be noted is that, as is clear from Tables Nos. 32 to 57, thirteenth invention alloys Nos. 13001 to 13006 are improved over first invention alloys No. 1005 and No. 1007—with the same composition as the thirteenth invention alloys—in machinability. It is thus confirmed that a proper heat treatment can further enhance machinability in accordance with the present invention.

In another series of tests, the first to thirteenth invention alloys were examined in comparison with the conventional alloys in hot workability and mechanical properties. For this purpose, hot compression and tensile tests were conducted the following way.

First, two test pieces—first and second test pieces—in the same shape, 15 mm in outside diameter and 25 mm in length, were cut out of each extruded test piece obtained as described above. In the hot compression tests, the first test piece was held for 30 minutes at 700° C., and then compressed 70 percent in the direction of axis to reduce the length from 25 mm to 7.5 mm. The surface condition after the compression (700° C. deformability) was visually evaluated. The results are given in Table 32 through Table 58. The evaluation of deformability was made by visually checking for cracks on the side of the test piece. In Table 32–Table 58, the test pieces with no cracks found are marked "○", those with small cracks are indicated by "Δ", and those with large cracks are represented by a symbol "×". The second test pieces were subjected to tensile testing by conventional testing procedures to determine their tensile strength, in $N/mm^2$, and their elongation, in %.

As the test results of the hot compression and tensile tests in Table 32 through Table 58 indicate, it was confirmed that the first to thirteenth invention alloys are equal to or superior to the conventional alloys Nos. 14001 to 14004 and No. 14006 in hot workability and mechanical properties and are suitable for industrial use. The seventh and eighth invention alloys in particular have the same level of mechanical properties as the conventional alloy No.14005, the aluminum bronze alloy which is highest in strength of the expanded copper alloys having JIS designations. Thus, the seventh and eighth invention alloys are characterized by prominent high strength features.

Furthermore, the first to six and ninth to thirteenth invention alloys were subjected to dezincing corrosion and stress corrosion cracking tests in accordance with the test methods detailed in ISO 6509 and JIS H 3250, respectively, in order to examine their corrosion resistance and resistance to stress corrosion cracking in comparison with the conventional alloys.

In the dezincification corrosion test conducted according to the ISO 6509 method, a sample taken from each extruded test piece was imbedded in a phenolic resin material in such a way that part of the side surface of the sample is exposed, the exposed surface being perpendicular to the extrusion direction of the extruded test piece. The surface of the sample was polished with emery paper No. 1200, and then ultrasonic-washed in pure water and dried. The sample thus prepared was dipped in a 12.7 g/l aqueous solution of cupric chloride dehydrate ($CuCl_2.2\,H_2O$) 1.0% and left standing for 24 hours at 75° C. The sample was taken out of the aqueous solution and the maximum depth of dezincification corrosion was determined. The measurements of the maximum dezincification corrosion depth are given in Table 32 to Table 43 and Table 53 to Table 58.

As is clear from the results of dezincification corrosion tests shown in Table 32 to Table 43 and Table 53 to Table 58, the first to fourth invention alloys and the ninth to thirteenth invention alloys are excellent in corrosion resistance and compare favorably to the conventional alloys of the prior art Nos. 14001 to 14003 containing great amounts of lead. Also it was confirmed that especially the fifth and sixth invention alloys, which seek improvement in both machinability and corrosion resistance, are very high in corrosion resistance.

In stress corrosion cracking tests conducted in accordance with the test method described in JIS H 3250, a 150-mm-long sample was cut out from each extruded test piece. The sample was bent with its center placed on an arc-shaped tester with a radius of 40 mm in such a way that one end and the other end form an angle of 45 degrees. The test sample thus subjected to a tensile residual stress was degreased and dried, and then placed in an ammonia environment in the desiccator with a 12.5% aqueous ammonia (ammonia diluted in the equivalent of pure water). The test sample was held some 80 mm above the surface of aqueous ammonia in the desiccator. After the test sample was left standing in the ammonia environment for periods of two hours, 8 hours, and 24 hours, the test sample was taken out from the desiccator, washed in sulfuric acid solution 10%, and examined for cracks under a magnifier of 10 magnifications. The results are given in Table 32 to Table 43 and Table 53 to Table 58. In those tables, the alloys which have developed clear cracks when held in the ammonia environment for two hours are marked "××" The test samples which had no cracks after two hours but were found to be clearly cracked at 8 hours are indicated by "×" The test samples which had no cracks at 8 hours, but were found to have clear cracks at 24 hours were indicated by "Δ". The test samples which were found to have no cracks at all at 24 hours are identified by the symbol "○."

As is indicated by the results of the stress corrosion cracking tests reported in Table 32 to Table 43 and Table 53 to Table 58, it was confirmed that not only the fifth and sixth invention alloys which seek improvement in both machinability and corrosion resistance but also the first to fourth invention alloys and the ninth and thirteenth alloys in which nothing particular was done to improve corrosion resistance were both equal to conventional alloy No. 14005, an aluminum bronze alloy containing no zinc, in stress corrosion cracking resistance.

In addition, oxidation tests were carried out to study the high-temperature oxidation resistance of the ninth to twelfth invention alloys in comparison with the conventional alloys. A test piece in the shape of a round bar with the surface cut to a outside diameter of 14 mm and the length cut to 30 mm was prepared from each of the following extruded test pieces: No. 9001 to No. 9005, No. 10001 to No. 10008, No. 11001 to No. 11007, No. 12001 to No. 12021, and No. 14001 to No. 14005. Each test piece was then weighed to measure the weight before oxidation. After that, the test piece was placed in a porcelain crucible and held in an electric furnace maintained at 500° C. After the passage of 100 hours, the test piece was taken out of the electric furnace and was weighed to measure the weight after oxidation. The increase in weight by oxidation was calculated from the measurements before and after oxidation. It is understood that the increase due to oxidation is an amount, in mg, of increase in weight by oxidation per 10 $cm^2$ of the surface area of the test piece and is calculated by the equation: increase in weight by oxidation, mg/10 $cm^2$=(weight, mg, after oxidation−weight, mg, before oxidation)×(10 $cm^2$/surface area, in $cm^2$, of test piece). The weight of each test piece increased after oxidation. This increase was brought about by high-temperature oxidation. When subjected to a high temperature, oxygen combines with copper, zinc, and silicon to form $Cu_2O$, ZnO, $SiO_2$, respectively. Thus, an increase of oxygen contributes to the weight gain. It can be said, therefore, that the smaller in weight increase by oxidation of the alloy, the more excellent in high-temperature oxidation resistance. The results obtained are shown in Table 53 to Table 56 and Table 58.

As is evident from the test results shown in Table 53 to Table 56 and Table 58, the ninth to twelfth invention alloys are equal to conventional alloy No. 14005, an aluminum bronze alloy ranking high in resistance to high-temperature oxidation among the expanded copper alloys having JIS designations. Thus, it was confirmed that the ninth to twelfth invention alloys are very excellent in machinability and that they are resistant to high-temperature oxidation as well.

Example 2

As the second series of examples of the present invention, cylindrical ingots with compositions given in Tables 13 to 25, each 100 mm in outside diameter and 200 mm in length, were hot extruded into a round bar 35 mm in outside diameter at 700° C. to produce the following test pieces: seventh invention alloys Nos. 7001a to 7030a and eighth invention alloys Nos. 8001a to 8147a. In parallel, cylindrical ingots with compositions given in Table 31, each 100 mm in outside diameter and 200 mm in length, were hot extruded into a round bar 35 mm in outside diameter at 700° C. to produce the following alloy test pieces: Nos. 14001a to 14005a, as second comparative examples from the prior art (hereinafter referred to as the "conventional alloys"). It is noted that the alloys Nos. 7001a to 7030a, Nos. 8001a to 8147a, and Nos. 14001a to 14005a are identical in composition with the aforesaid copper alloys Nos. 7001 to 7030, Nos. 8001 to 8147, and Nos. 14001 to No. 14005, respectively.

These seventh invention alloys Nos. 7001a to 7030a and eighth invention alloys Nos. 8001a to 8147a were put to wear resistance tests in comparison with the conventional alloys Nos. 14001a to 14005a. The tests were carried out in the following manner. Each extruded test piece thus obtained was cut on the circumferential surface, holed, and cut down into a ring-shaped test piece 32 mm in outside diameter and 10 mm in thickness (that is, length in the axial direction). The test piece was then fitted around a free-rotating shaft, and a roll 48 mm in outside diameter placed in parallel with the axis of the shaft was urged against the test piece under a load of 50 kg. The roll was made of stainless steel having the JIS designation SUS 304. Then, the SUS 304 roll and the test piece put in rotational sliding contact with the roll were rotated at the same rate of revolutions/minute—209 r.p.m.—with multipurpose gear oil dropping to the circumferential surface of the test piece. When the number of revolutions reached 100,000, the SUS 304 roll and the test piece were stopped, and the weight difference between the start and the end of rotation, that is, the loss of weight by wear, in mg, was determined. It can be said that the alloys which show less loss of weight by wear are higher in wear resistance. The results are given in Tables 59 to 68.

As is clear from the wear resistance test results shown in Tables 59 to 68, these tests showed that seventh invention alloys Nos. 7001a to 7030a and eighth invention alloys Nos. 8001a to 8147a were excellent in wear resistance as compared with not only conventional alloys Nos. 14001a to 14004a but also No. 14005a, which is an aluminum bronze alloy characterized by the highest wear resistance of the expanded copper alloys having JIS designations. From comprehensive considerations of the test results including the tensile test results, it may be concluded that the seventh and eighth invention alloys are excellent in machinability and that they also possess higher strength features and wear resistance than does the aluminum bronze which is the highest in wear resistance of all the expanded copper alloys listed in the JIS designations.

Alloy Composition Constraint Formula

Another feature of the copper alloys of the present invention is that each copper alloy composition is constrained by the general formula relationship $$55 \leqq X-3Y+a_0Z_0 \leqq 70 \quad (1)$$

where X is the percent, by weight, of copper; Y is the percent, by weight, of silicon; and $a_0Z_0$ represents the contribution to the relationship of elements other than copper, silicon and zinc. In other words, the relationship described by the alloy composition constraint formula (1) is required to make copper alloy compositions with the advantages described above. If formula (1) is not satisfied, then by experiment it has been found that the resulting copper alloy does not provide the degree of machinability and other properties shown in Tables 32–57.

We describe the contribution to the relationship of constraint formula (1) by elements other than copper, silicon and zinc in formula (2) as follows:

$$a_0Z_0=a_1Z_1+a_2Z_2+a_3Z_3+\ldots \quad (2)$$

where $a_1$, $a_2$, $a_3$, etc., are experimentally determined coefficients, and $Z_1$, $Z_2$, $Z_3$, etc., are percents, by weight, of elements in the composition other than copper, silicon and zinc.

Specifically, it has been determined that in order to practice the copper alloys of the present invention, the "a" coefficients are as follows: for bisthmuth, tellurium, selenium, antimony, arsenic and titanium, the a coefficient is zero; for tin, the a coefficient is −0.5; for aluminum, the a coefficient is −2; for phosphorus, the a coefficient is −3; for chromium, the a coefficient is +2; and for manganese and nickel, the a coefficient is +2.5. It will be appreciated by one skilled in the art, that formula (1) does not directly constrain the amounts of bismuth, tellurium, selenium, antimony, arsenic and titanium in the copper alloys of the present invention because the a coefficient is zero for these elements; however, these elements are indirectly constrained by the fact that the percent, by weight, of copper, silicon, and those elements in the copper alloy and having non-zero a coefficients must satisfy constraint formula (1).

To be even more specific, for the first and second invention alloys, constraint formula (1) can be written as:

$$55 \leqq X-3Y \leqq 70, \quad (3)$$

where X is the percent, by weight, of copper; and Y is the percent, by weight, of silicon in the alloy.

For the third, fourth, fifth and sixth invention alloys, constraint formula (1) can be written as:

$$55 \leqq X-3Y+aZ+bW \leqq 70, \quad (4)$$

where X is the percent, by weight, of copper; Y is the percent, by weight, of silicon; Z is the percent, by weight of tin; W is the percent, by weight, of phosphorus in the alloy; a is −0.5; and b is −3.

For the nineth and eleventh invention alloys, constraint formula (1) can be written as:

$$55 \leqq X-3Y+aZ+bW \leqq 70, \quad (5)$$

where X is the percent, by weight, of copper; Y is the percent, by weight, of silicon; Z is the percent, by weight of aluminum; W is the percent, by weight, of phosphorus in the alloy; a is −2; and b is −3.

For the tenth and twelfth invention alloys, constraint formula (1) can be written as:

$$55 \leqq X-3Y+aZ+bW+cV \leqq 70, \quad (6)$$

where X is the percent, by weight, of copper; Y is the percent, by weight, of silicon; Z is the percent, by weight of aluminum; W is the percent, by weight, of phosphorus; V is the percent, by weight, of chromium in the alloy; a is −2; b is −3; and c is +2.

For the seventh and eighth invention alloys constraint formula (1) can be written as:

$$55 \leqq X-3Y+aZ+bW+cV+dU \leqq 70, \quad (7)$$

where X is the percent, by weight, of copper; Y is the percent, by weight, of silicon; Z is the percent, by weight of tin; W is the percent, by weight, of phosphorus; V is the percent, by weight, of manganese; U is the percent, by weight, of nickel; a is −0.5; b is −3; c is +2.5; and d is +2.5. It has also been determined for the seventh and eighth invention alloys that a secondary alloy composition constraint is necessary to practice the invention. This secondary alloy composition constraint formula is a ratio involving silicon, manganese and nickel describing the constraining composition as follows:

$$0.7 \leqq Y/(V+U) \leqq 6, \quad (8)$$

where Y, V and U are the percents, by weight, of silicon, manganese, and nickel respectively.

To summarize, all of the first through the twelfth invention alloys of the present invention must satisfy the alloy composition constraint of Formula 1, and all of the illustrative examples in Tables 1–29 comply with this composition constraint. Only the seventh and eighth invention alloys are further constrained by the secondary alloy composition constraint of Formula 8. Other copper alloys that contain the same elements as the copper alloys of the present invention, but which do not have a composition satisfying the requirements of Formula 1, and when appropriate Formula 8 as well, will not have the characteristics of the copper alloys disclosed in Tables 1–29.

In addition, it is emphasized that the desired metallurgic characteristics of the copper metal alloys of the present invention are present when constraint formula 1 has an upper limit of 70 and a lower limit of 55; however, the preferred range includes the upper limit of 70 and a lower limit of 60. In other words, the the preferred relationship is $60 \leqq X-3Y+a_0Z_0 \leqq 70$, although the relationship $55 \leqq X-3Y+a_0Z_0 \leqq 70$ still produces lead free copper alloys having suitable metallurgic characteristics such as excellent strength and wear resistance. This is because copper alloys satisfying formula 1 in the range $55 \leqq X-3Y+a_0Z_0 < 60$ have acceptable machinability, but due to an increase in the β phase of the metal matrix as is discussed in detail below, the copper alloys in this range have less corrosion resistance and less impact strength than copper alloys in the range $60 \leqq X-3Y+a_0Z_0 \leqq 70$. Consequently, to produce copper alloys in accordance with the present invention, the composition of the alloy must satisfy the relationship $60 \leqq X-3Y+a_0Z_0 \leqq 70$ if superior ductility and desired.

Metal Construction

Another important feature of the copper alloys of the present invention is the metal construction, being the matrix of the metal, formed by the integration of multiple phase states of the component metals, which produces a composite phase for the copper alloy. Specifically, as one skilled in the art will appreciate, a given metal alloy may have different characteristics depending upon the environment in which it was produced. For example, applying heat to temper steel is well known. The fact that a given metal alloy may behave differently depending upon the conditions in which it was forged is due to the integration and conversion of components of the metal to different phase states. As is illustrated in Tables 1–30, the copper alloys of the present invention all include an a phase of about 30 percent or more of the total phase area to practice the invention. This is because the α phase is a soft phase and is the only phase that gives metal alloys a degree of cold workability. In other words, if the copper alloy has less than about 30% α phase comprising the total phase area of the metal, then the copper alloy is not cold workable and can not be further processed by cutting in any practical manner. Therefore, all of the copper alloys of the present invention have a metal construction that is a composite phase that is an α phase matrix to which other phases are provided. The presence of a sufficient percentage, relative to the total phase area of the metal construction, of the α phase improves the machinability of the copper alloy even without the presence of lead in the composition of the alloy.

As mentioned above, the presence of silicon in the copper alloys of the present invention is to improve the machinability of the copper alloy, and this occurs partly because silicon induces a γ phase. Silicon concentrations in any one of the γ, κ, and μ phases of a copper alloy are 1.5 to 3.5 times as high as that in the α phase. Silicon concentrations in the various phases, from high to low, are as follows: $\mu \geqq \gamma \geqq \kappa \geqq \beta \geqq \alpha$. The γ, κ, and μ phases also share the characteristic that they are harder and more brittle than the α phase, and impart an appropriate hardness to the alloy so that the alloy is machinable and so that the cuttings formed by machining are less likely to damage the cutting tools as describe regarding FIG. 1. Therefore, to practice the invention, each copper alloy must have at least one of the γ phase, the κ phase, and the μ phase, or any combination of these phases, in the α phase in order to provide a suitable degree of hardness to the copper alloy.

Another goal of the copper alloys of the present invention is to limit the amount of β phase in the α matrix of the metal construction. It is desired to limit the β phase to 5% or less of the total phase area because the β phase does not contribute to either the machinability or the cold workability of the copper alloy. Preferably, the β phase is zero in the metal construction of the present invention, but it is acceptable to have the β phase contribute up to 5% of the total phase area.

Therefore, the copper alloys of the present invention, as illustrated in Tables 1–30, are constrained to a metal construction as follows: (1) an α phase matrix of about 30% or more; (2) a β phase of 5% or less; and consequently (3) any combination of the γ phase, the κ phase, and the μ phase totaling between 5–70% of the total phase area. In other words, the forging conditions described above and in the tables in combination with the elemental composition of the copper alloys of the present invention are constrained so that any one of: (a) α+γ+κ+μ phases (5%≦γ+κ+μ≦70%), (b) α+γ+κ phases (5%≦γ+κ+μ≦70%), (c) α+γ+μ phases (5%≦γ+μ≦70%), (d) α+κ+μ phases (5%≦κ+μ≦70%), (e) α+γ phases (5%≦γ≦70%), (f) α+κ phases (5%≦κ70%), and (g) α+μ phases (5%≦μ≦70%), are acceptable composite phases forming the metal construction subject to the caveat that the metal construction includes no more than 5% of the β phase.

Lastly, it is pointed out that although metal constructions are possible where the γ, κ, and μ phases may make up more than 70% of the total phase area, the result is a copper alloy that has no problem with machinability, but has an α phase matrix of less than 30% which results in such a poor degree of cold workability as to render the alloy of no practical value. On the other hand, if the copper has less than 5% of the total phase area comprised of the γ, κ, and μ phases then the machinability of the copper alloy is rendered unsatisfactory. The β phase is minimized to less than 5% of the total phase area because the β phase does not contribute to either the machinability or cold workability of the copper alloy. In addition, because the α phase is the soft phase for the metal construction, and therefore has ductility, the machinability of the copper alloy is excellent even in the absence of lead. The result is that the metal construction of the present invention utilizes the α phase as the matrix in which the γ, κ, and μ phases disperse.

Lastly, in light of the above discussion and Tables 32–57 and 59–67, which showcase the various advantages of the lead free copper alloys of the present invention when compared to the metallurgic characteristics of the prior art conventional alloys illustrated in Tables 58 and 68, several aspects of the present invention are highlighted. Specifically, with respect to the first and second invention alloys the silicon percentage, by weight, is set at greater than 3 weight percent (wt %) to maintain the excellent corrosion resistance; however, in the copper metal alloys of the present invention that include tin and phosphorous, such as for the third and fourth invention alloys, the weight percent of silicon is less critical because the tin and phosphorous provide the corrosion resistance.

It is additionally pointed out that the third and fourth invention alloys do not contain aluminum because these alloys are produced to have excellent corrosion resistance (also known as "dezincification resistance") as well as excellent strength and machinability. In fact, the strength and machinability of the third and fourth invention alloys is comparable to the strength and machinability of the first and second invention alloys. These metallurgical characteristics are achieved by the presence of tin and phosphorous in the composition of the third and fourth invention alloys, but the addition of aluminum would defeat the benefits provided by the tin and phosphorous.

Likewise, the seventh and eighth invention alloys do not contain aluminum. The goal of the compositions of the seventh and eighth invention alloys is to improve the strength and wear resistance of the copper alloy relative to the strength and wear resistances of the third and fourth invention alloys. However, in order to retain the excellent dezincification resistance as is seen in the third and fourth invention alloys it is necessary to include at least one of tin or phosphorous in the compositions of the seventh and eighth invention alloys and to exclude the presence of aluminum.

While the present invention has been described with reference to certain preferred embodiments, one of ordinary skill in the art will recognize that additions, deletions, substitutions, modifications and improvements can be made while remaining within the spirit and scope of the present invention as defined by the appended claims.

TABLE 1

| | alloy composition (wt %) | | | metal construction | |
|---|---|---|---|---|---|
| No. | Cu | Si | Zn | phases | γ + κ +μ (%) |
| 1001 | 72.8 | 3.1 | remainder | α + β + γ | 30 |
| 1002 | 76.5 | 3.4 | remainder | α + κ + μ | 50 |
| 1003 | 74.8 | 3.1 | remainder | α + γ + κ | 30 |
| 1004 | 77.6 | 3.7 | remainder | α + κ + μ | 65 |
| 1005 | 78.5 | 3.2 | remainder | α + κ + μ | 40 |

TABLE 2

| | alloy composition (wt %) | | | | | | metal construction | |
|---|---|---|---|---|---|---|---|---|
| No. | Cu | Si | Bi | Te | Se | Zn | phases | γ + κ + μ(%) |
| 2001 | 75.2 | 3.2 | | | 0.19 | remainder | α + γ + κ | 40 |
| 2002 | 72.6 | 3.1 | | 0.25 | | remainder | α + β + γ | 30 |
| 2003 | 77.6 | 3.8 | 0.05 | 0.09 | | remainder | α + κ + μ | 65 |
| 2004 | 75.8 | 3.5 | 0.11 | | 0.05 | remainder | α + κ + μ | 55 |
| 2005 | 76.4 | 3.4 | 0.03 | 0.05 | 0.11 | remainder | α + κ + μ | 50 |
| 2006 | 78.2 | 3.4 | | 0.14 | 0.03 | remainder | α + κ | 50 |
| 2008 | 78.2 | 3.7 | 0.33 | | | remainder | α + κ + μ | 65 |

TABLE 3

| | alloy composition (wt %) | | | | | metal construction | |
|---|---|---|---|---|---|---|---|
| No | Cu | Si | Sn | P | Zn | phases | γ + κ + μ(%) |
| 3001 | 71.8 | 2.4 | 3.1 | | remainder | α + β + γ | 35 |
| 3004 | 74.9 | 3.2 | | 0.09 | remainder | α + γ + κ | 40 |
| 3005 | 71.6 | 2.4 | 2.3 | 0.03 | remainder | α + β + γ | 30 |
| 3008 | 77.5 | 3.5 | 0.4 | | remainder | α + γ + κ + μ | 60 |
| 3009 | 75.4 | 3 | 1.7 | | remainder | α + β + γ + κ | 40 |
| 3010 | 76.5 | 3.3 | | 0.21 | remainder | α + γ + κ | 50 |
| 3011 | 73.8 | 2.7 | | 0.04 | remainder | α + γ + κ | 20 |
| 3012 | 75 | 2.9 | 1.6 | 0.1 | remainder | α + γ + κ | 40 |

TABLE 4

| | alloy composition (wt %) | | | | | | | metal construction | |
|---|---|---|---|---|---|---|---|---|---|
| No. | Cu | Si | Sn | Bi | Te | Se | Zn | phases | $\gamma + \kappa + \mu$(%) |
| 4001 | 70.8 | 1.9 | 3.4 | 0.36 | | | remainder | $\alpha + \beta + \gamma$ | 30 |
| 4002 | 76.3 | 3.4 | 1.3 | | 0.03 | | remainder | $\alpha + \gamma + \kappa$ | 60 |
| 4003 | 73.2 | 2.5 | 1.9 | | | 0.15 | remainder | $\alpha + \beta + \gamma$ | 30 |
| 4004 | 72.3 | 2.4 | 0.6 | 0.29 | 0.23 | | remainder | $\alpha + \gamma$ | 25 |
| 4005 | 74.2 | 2.7 | 2 | 0.03 | | 0.26 | remainder | $\alpha + \gamma + \kappa$ | 35 |
| 4006 | 75.4 | 2.9 | 0.4 | | 0.31 | 0.03 | remainder | $\alpha + \gamma + \kappa$ | 30 |
| 4007 | 71.5 | 2.1 | 2.6 | 0.11 | 0.05 | 0.23 | remainder | $\alpha + \beta + \gamma$ | 30 |

TABLE 5

| | alloy composition (wt %) | | | | | | | | metal construction | |
|---|---|---|---|---|---|---|---|---|---|---|
| No. | Cu | Si | Sn | Bi | Te | Se | P | Zn | phases | $\gamma + \kappa + \mu$(%) |
| 4022 | 70.9 | 2.1 | | 0.11 | | | 0.11 | remainder | $\alpha + \beta + \gamma$ | 10 |
| 4023 | 74.8 | 3.1 | | | 0.07 | | 0.06 | remainder | $\alpha + \gamma + \kappa$ | 30 |
| 4024 | 76.3 | 3.2 | | | | 0.05 | 0.02 | remainder | $\alpha + \gamma + \kappa$ | 35 |
| 4025 | 78.1 | 3.1 | | 0.26 | 0.02 | | 0.15 | remainder | $\alpha + \kappa$ | 35 |
| 4026 | 71.1 | 2.2 | | 0.13 | | 0.02 | 0.05 | remainder | $\alpha + \beta + \gamma$ | 10 |
| 4027 | 74.1 | 2.7 | | 0.03 | 0.06 | 0.03 | 0.03 | remainder | $\alpha + \gamma + \kappa$ | 20 |
| 4028 | 70.6 | 1.9 | 3.2 | 0.31 | | | 0.04 | remainder | $\alpha + \beta + \gamma$ | 30 |
| 4029 | 73.6 | 2.4 | 2.3 | | 0.03 | | 0.04 | remainder | $\alpha + \beta + \gamma$ | 35 |
| 4030 | 73.4 | 2.6 | 1.7 | | | 0.31 | 0.22 | remainder | $\alpha + \beta + \gamma + \kappa$ | 35 |
| 4031 | 74.8 | 2.9 | 0.5 | 0.03 | 0.02 | | 0.05 | remainder | $\alpha + \gamma + \kappa$ | 30 |
| 4032 | 73 | 2.6 | 0.7 | 0.09 | | 0.02 | 0.08 | remainder | $\alpha + \gamma$ | 25 |
| 4033 | 74.5 | 2.8 | | | 0.03 | 0.12 | 0.05 | remainder | $\alpha + \gamma + \kappa$ | 25 |
| 4034 | 77.2 | 3.3 | 1.3 | | 0.03 | 0.12 | 0.04 | remainder | $\alpha + \gamma + \kappa$ | 50 |
| 4035 | 74.9 | 3.1 | 0.4 | 0.02 | 0.05 | 0.05 | 0.08 | remainder | $\alpha + \gamma + \kappa$ | 35 |

TABLE 6

| | alloy composition (wt %) | | | | | | | metal construction | |
|---|---|---|---|---|---|---|---|---|---|
| No. | Cu | Si | Sn | P | Sb | As | Zn | phases | $\gamma + \kappa + \mu$(%) |
| 5001 | 69.9 | 2.1 | 3.3 | | | | remainder | $\alpha + \beta + \gamma$ | 30 |
| 5002 | 74.1 | 2.7 | | 0.21 | | | remainder | $\alpha + \gamma + \kappa$ | 20 |
| 5003 | 75.8 | 2.4 | | | 0.14 | | remainder | $\alpha + \kappa + \mu$ | 15 |
| 5004 | 77.3 | 3.4 | | | | 0.05 | remainder | $\alpha + \kappa + \mu$ | 45 |
| 5005 | 73.4 | 2.4 | 2.1 | 0.04 | | | remainder | $\alpha + \gamma$ | 35 |
| 5006 | 75.3 | 2.7 | 0.4 | | 0.04 | | remainder | $\alpha + \kappa$ | 25 |
| 5007 | 70.9 | 2.2 | 2.4 | | | 0.07 | remainder | $\alpha + \beta + \gamma$ | 30 |
| 5008 | 71.2 | 2.6 | 1.1 | 0.03 | 0.03 | | remainder | $\alpha + \beta + \gamma$ | 30 |
| 5009 | 77.3 | 2.9 | 0.7 | 0.19 | | 0.03 | remainder | $\alpha + \kappa + \mu$ | 35 |
| 5010 | 78.2 | 3.1 | 0.4 | | 0.09 | 0.15 | remainder | $\alpha + \kappa$ | 40 |
| 5011 | 72.5 | 2.1 | 2.8 | 0.02 | 0.1 | 0.03 | remainder | $\alpha + \beta + \gamma$ | 35 |
| 5012 | 79 | 3.3 | | 0.24 | 0.02 | | remainder | $\alpha + \kappa + \mu$ | 45 |
| 5013 | 75.6 | 2.9 | | 0.07 | | 0.14 | remainder | $\alpha + \kappa$ | 25 |
| 5014 | 74.8 | 3 | | | 0.11 | 0.02 | remainder | $\alpha + \gamma + \kappa$ | 30 |
| 5015 | 74.3 | 2.8 | | 0.06 | 0.02 | 0.03 | remainder | $\alpha + \gamma + \kappa$ | 20 |
| 5016 | 72.9 | 2.5 | | 0.03 | | | remainder | $\alpha + \gamma$ | 20 |
| 5017 | 77 | 3.4 | | 0.14 | | | remainder | $\alpha + \kappa + \mu$ | 50 |
| 5018 | 76.8 | 3.2 | 0.7 | 0.12 | | | remainder | $\alpha + \gamma + \kappa$ | 45 |
| 5019 | 74.5 | 2.8 | 1.8 | | | | remainder | $\alpha + \gamma + \kappa$ | 40 |
| 5020 | 74.9 | 3 | | 0.2 | 0.05 | | remainder | $\alpha + \gamma + \kappa$ | 30 |

TABLE 7

| | alloy composition (wt %) | | | | | | | | | metal construction | |
|---|---|---|---|---|---|---|---|---|---|---|---|
| No. | Cu | Si | Sn | Bi | Te | P | Sb | As | Zn | phases | $\gamma + \kappa + \mu$(%) |
| 6001 | 69.6 | 2.1 | 3.2 | 0.15 | | | | | remainder | $\alpha + \beta + \gamma$ | 30 |
| 6002 | 77.3 | 3.7 | 0.5 | 0.02 | | 0.23 | | | remainder | $\alpha + \kappa + \mu$ | 65 |
| 6003 | 75.2 | 2.4 | 1.1 | 0.33 | | | 0.12 | | remainder | $\alpha + \gamma$ | 25 |
| 6004 | 70.9 | 2.3 | 3.1 | 0.11 | | | | 0.03 | remainder | $\alpha + \beta + \gamma$ | 30 |
| 6005 | 78.1 | 2.7 | 0.6 | 0.14 | | 0.02 | 0.07 | | remainder | $\alpha + \kappa + \mu$ | 30 |
| 6006 | 74.5 | 2.6 | 1.5 | 0.21 | | 0.1 | | 0.04 | remainder | $\alpha + \gamma + \kappa$ | 35 |

TABLE 7-continued

| | alloy composition (wt %) | | | | | | | | | metal construction | |
|---|---|---|---|---|---|---|---|---|---|---|---|
| No. | Cu | Si | Sn | Bi | Te | P | Sb | As | Zn | phases | $\gamma + \kappa + \mu$(%) |
| 6007 | 74.7 | 3.2 | 2.1 | 0.05 | | | 0.02 | 0.12 | remainder | $\alpha + \beta + \gamma$ | 45 |
| 6008 | 73.8 | 2.5 | 0.7 | 0.31 | | 0.03 | 0.02 | 0.1 | remainder | $\alpha + \gamma$ | 25 |
| 6009 | 74.5 | 2.9 | | 0.05 | | 0.19 | | | remainder | $\alpha + \gamma + \kappa$ | 25 |
| 6010 | 78.1 | 3.1 | | 0.11 | | | 0.15 | | remainder | $\alpha + \kappa + \mu$ | 45 |
| 6011 | 74.6 | 3.3 | | 0.02 | | | | 0.22 | remainder | $\alpha + \gamma$ | 45 |
| 6012 | 69.9 | 2.3 | | 0.35 | | 0.08 | 0.02 | | remainder | $\alpha + \beta + \gamma$ | 15 |
| 6013 | 73.2 | 2.6 | | 0.21 | | 0.03 | | 0.07 | remainder | $\alpha + \gamma + \kappa$ | 20 |
| 6014 | 76.3 | 2.9 | | 0.07 | | | 0.09 | 0.02 | remainder | $\alpha + \gamma + \kappa$ | 30 |
| 6015 | 74.4 | 2.8 | | 0.19 | | 0.13 | 0.03 | 0.02 | remainder | $\alpha + \gamma + \kappa$ | 25 |
| 6016 | 70.5 | 2.3 | 2.9 | 0.1 | 0.02 | | | | remainder | $\alpha + \beta + \gamma$ | 30 |
| 6017 | 74.7 | 2.4 | 0.9 | 0.31 | 0.04 | 0.05 | | | remainder | $\alpha + \gamma + \kappa$ | 25 |
| 6018 | 78.1 | 3.8 | 0.6 | 0.02 | 0.33 | | 0.07 | | remainder | $\alpha + \kappa + \mu$ | 65 |
| 6019 | 69.4 | 2 | 3.4 | 0.11 | 0.03 | | | 0.03 | remainder | $\alpha + \beta + \gamma$ | 20 |
| 6020 | 77.8 | 2.8 | 0.5 | 0.06 | 0.11 | 0.21 | 0.02 | | remainder | $\alpha + \kappa + \mu$ | 30 |

TABLE 8

| | alloy composition (wt %) | | | | | | | | | | metal construction | |
|---|---|---|---|---|---|---|---|---|---|---|---|---|
| No. | Cu | Si | Sn | Bi | Te | Se | P | Sb | As | Zn | phases | $\gamma + \kappa + \mu$(%) |
| 6021 | 74.2 | 2.6 | 0.6 | 0.2 | 0.03 | | 0.02 | | 0.14 | remainder | $\alpha + \gamma + \kappa$ | 25 |
| 6022 | 75.8 | 3.3 | 1.8 | 0.03 | 0.06 | | | 0.11 | 0.02 | remainder | $\alpha + \beta + \gamma + \kappa$ | 50 |
| 6023 | 74.4 | 2.6 | 1.5 | 0.09 | 0.12 | | 0.03 | 0.02 | 0.06 | remainder | $\alpha + \beta + \gamma$ | 35 |
| 6024 | 77.3 | 3.1 | | 0.02 | 0.25 | | 0.08 | | | remainder | $\alpha + \kappa$ | 35 |
| 6025 | 70.5 | 2.4 | | 0.12 | 0.04 | | 0.06 | 0.03 | | remainder | $\alpha + \beta + \gamma$ | 15 |
| 6026 | 74.3 | 2.9 | | 0.24 | 0.02 | | 0.13 | | 0.11 | remainder | $\alpha + \gamma + \kappa$ | 25 |
| 6027 | 69.8 | 2.3 | | 0.34 | 0.03 | | 0.21 | 0.02 | 0.02 | remainder | $\alpha + \beta + \gamma$ | 10 |
| 6028 | 74.5 | 2.9 | | 0.03 | 0.11 | | | 0.13 | | remainder | $\alpha + \gamma + \kappa$ | 25 |
| 6029 | 78.4 | 3.2 | | 0.02 | 0.08 | | | 0.04 | 0.05 | remainder | $\alpha + \kappa + \mu$ | 45 |
| 6030 | 73.8 | 3 | | 0.08 | 0.31 | | | | 0.23 | remainder | $\alpha + \beta + \gamma$ | 25 |
| 6031 | 72.8 | 2.5 | 1.6 | 0.11 | | 0.36 | | | | remainder | $\alpha + \beta + \gamma$ | 30 |
| 6032 | 78.1 | 3.7 | 0.5 | 0.03 | | 0.02 | 0.05 | | | remainder | $\alpha + \kappa + \mu$ | 60 |
| 6033 | 77.2 | 2.8 | 0.6 | 0.09 | | 0.04 | | 0.07 | | remainder | $\alpha + \kappa$ | 30 |
| 6034 | 76.9 | 3.8 | 0.4 | 0.03 | | 0.06 | | | 0.07 | remainder | $\alpha + \gamma + \kappa$ | 65 |
| 6035 | 74.1 | 2.3 | 3.3 | 0.06 | | 0.03 | 0.02 | 0.05 | | remainder | $\alpha + \beta + \gamma$ | 40 |
| 6036 | 69.8 | 2 | 2.5 | 0.31 | | 0.12 | 0.03 | | 0.06 | remainder | $\alpha + \beta + \gamma$ | 20 |
| 6037 | 74.9 | 3 | 1.1 | 0.07 | | 0.21 | | 0.12 | 0.02 | remainder | $\alpha + \gamma$ | 40 |
| 6038 | 72.6 | 2.8 | 0.6 | 0.2 | | 0.05 | 0.21 | 0.07 | 0.03 | remainder | $\alpha + \beta + \gamma$ | 25 |
| 6039 | 69.7 | 2.3 | | 0.23 | | 0.06 | 0.1 | | | remainder | $\alpha + \beta + \gamma$ | 15 |
| 6040 | 75.4 | 3 | | 0.02 | | 0.09 | 0.11 | 0.03 | | remainder | $\alpha + \gamma + \kappa$ | 30 |

TABLE 9

| | alloy composition (wt %) | | | | | | | | | | metal construction | |
|---|---|---|---|---|---|---|---|---|---|---|---|---|
| No. | Cu | Si | Sn | Bi | Te | Se | P | Sb | As | Zn | phases | $\gamma + \kappa + \mu$(%) |
| 6041 | 73.2 | 2.5 | | 0.11 | | 0.36 | 0.05 | | 0.02 | remainder | $\alpha + \gamma$ | 20 |
| 6042 | 78.2 | 3.7 | | 0.03 | | 0.04 | 0.03 | 0.04 | 0.01 | remainder | $\alpha + \kappa + \mu$ | 65 |
| 6043 | 77.8 | 2.8 | | 0.09 | | 0.02 | | 0.04 | | remainder | $\alpha + \kappa$ | 30 |
| 6044 | 73.4 | 2.6 | | 0.16 | | 0.06 | | 0.03 | 0.02 | remainder | $\alpha + \gamma + \kappa$ | 20 |
| 6045 | 71.2 | 2.4 | | 0.35 | | 0.14 | | | 0.08 | remainder | $\alpha + \beta + \gamma$ | 15 |
| 6046 | 70.3 | 2.5 | 1.9 | 0.09 | 0.05 | 0.03 | | | | remainder | $\alpha + \beta + \gamma$ | 30 |
| 6047 | 74.5 | 3.6 | 2.2 | 0.02 | 0.2 | 0.04 | 0.04 | | | remainder | $\alpha + \beta + \gamma$ | 50 |
| 6048 | 73.8 | 2.9 | 1.2 | 0.03 | 0.1 | 0.05 | | 0.12 | | remainder | $\alpha + \beta + \gamma$ | 40 |
| 6049 | 69.8 | 2.1 | 3.1 | 0.32 | 0.03 | 0.05 | | | 0.13 | remainder | $\alpha + \beta + \gamma$ | 25 |
| 6050 | 74.2 | 2.2 | 0.6 | 0.19 | 0.11 | 0.02 | 0.02 | 0.03 | | remainder | $\alpha + \gamma + \kappa$ | 20 |
| 6051 | 74.8 | 3.2 | 0.5 | 0.03 | 0.07 | 0.03 | 0.05 | | 0.02 | remainder | $\alpha + \gamma$ | 40 |
| 6052 | 78 | 2.8 | 0.6 | 0.06 | 0.04 | 0.11 | | 0.11 | 0.03 | remainder | $\alpha + \kappa$ | 30 |
| 6053 | 76.3 | 2.4 | 0.8 | 0.05 | 0.03 | 0.22 | 0.03 | 0.04 | 0.03 | remainder | $\alpha + \kappa + \mu$ | 25 |
| 6054 | 74.2 | 2.6 | | 0.21 | 0.02 | 0.04 | 0.05 | | | remainder | $\alpha + \gamma + \kappa$ | 20 |
| 6055 | 78.2 | 2.9 | | 0.16 | 0.08 | 0.03 | 0.21 | 0.03 | | remainder | $\alpha + \kappa$ | 25 |
| 6056 | 72.3 | 2.5 | | 0.08 | 0.36 | 0.02 | 0.1 | | 0.04 | remainder | $\alpha + \gamma + \kappa$ | 20 |

TABLE 9-continued

| | alloy composition (wt %) | | | | | | | | | | metal construction | |
|---|---|---|---|---|---|---|---|---|---|---|---|---|
| No. | Cu | Si | Sn | Bi | Te | Se | P | Sb | As | Zn | phases | $\gamma + \kappa + \mu$(%) |
| 6057 | 69.8 | 2.4 | | 0.36 | 0.04 | 0.04 | 0.06 | 0.07 | 0.02 | remainder | $\alpha + \beta + \gamma$ | 15 |
| 6058 | 74.6 | 3.1 | | 0.05 | 0.09 | 0.04 | | 0.14 | | remainder | $\alpha + \gamma + \kappa$ | 30 |
| 6059 | 73.8 | 2.5 | | 0.08 | 0.05 | 0.03 | | 0.02 | 0.04 | remainder | $\alpha + \gamma + \kappa$ | 20 |
| 6060 | 74.9 | 2.7 | | 0.03 | 0.16 | 0.02 | | | 0.03 | remainder | $\alpha + \gamma + \kappa$ | 20 |

TABLE 10

| | alloy composition (wt %) | | | | | | | | | metal construction | |
|---|---|---|---|---|---|---|---|---|---|---|---|
| No | Cu | Si | Sn | Te | Se | P | Sb | As | Zn | phases | $\gamma + \kappa + \mu$(%) |
| 6061 | 69.7 | 2.6 | 3.1 | 0.26 | | | | | remainder | $\alpha + \beta + \gamma$ | 25 |
| 6062 | 74.2 | 3.2 | 0.6 | 0.03 | | 0.04 | | | remainder | $\alpha + \gamma$ | 40 |
| 6063 | 74.9 | 2.6 | 0.7 | 0.14 | | | 0.14 | | remainder | $\alpha + \gamma + \kappa$ | 25 |
| 6064 | 73.8 | 3 | 0.4 | 0.07 | | | | 0.13 | remainder | $\alpha + \gamma$ | 35 |
| 6065 | 78.1 | 3.3 | 0.8 | 0.02 | | 0.12 | 0.02 | | remainder | $\alpha + \gamma + \kappa$ | 55 |
| 6066 | 72.8 | 2.4 | 1.2 | 0.32 | | 0.03 | | 0.05 | remainder | $\alpha + \beta + \gamma$ | 25 |
| 6067 | 73.6 | 2.7 | 2.1 | 0.03 | | | 0.07 | 0.02 | remainder | $\alpha + \beta + \gamma$ | 35 |
| 6068 | 72.3 | 2.6 | 0.5 | 0.16 | | 0.02 | 0.04 | 0.03 | remainder | $\alpha + \beta + \gamma$ | 25 |
| 6069 | 70.6 | 2.3 | | 0.33 | | 0.09 | | | remainder | $\alpha + \beta + \gamma$ | 15 |
| 6070 | 76.5 | 3.2 | | 0.14 | | 0.21 | 0.03 | | remainder | $\alpha + \gamma + \kappa$ | 40 |
| 6071 | 74.5 | 3.1 | | 0.05 | | 0.03 | | 0.03 | remainder | $\alpha + \gamma + \kappa$ | 35 |
| 6072 | 72.8 | 2.7 | | 0.08 | | | 0.13 | | remainder | $\alpha + \gamma + \kappa$ | 25 |
| 6073 | 78 | 3.8 | | 0.04 | | | 0.02 | 0.12 | remainder | $\alpha + \kappa + \mu$ | 65 |
| 6074 | 73.8 | 2.9 | | 0.2 | | | | 0.1 | remainder | $\alpha + \gamma + \kappa$ | 30 |
| 6075 | 74.5 | 2.9 | | 0.07 | | 0.04 | 0.1 | 0.02 | remainder | $\alpha + \gamma + \kappa$ | 25 |
| 6076 | 73.6 | 3.2 | 2.1 | 0.04 | 0.07 | | | | remainder | $\alpha + \beta + \gamma$ | 40 |
| 6077 | 74.1 | 2.5 | 0.8 | 0.21 | 0.18 | 0.05 | | | remainder | $\alpha + \gamma + \kappa$ | 25 |
| 6078 | 77.8 | 2.9 | 0.6 | 0.11 | 0.05 | | 0.07 | | remainder | $\alpha + \kappa$ | 35 |
| 6079 | 71.5 | 2.1 | 1.1 | 0.06 | 0.03 | | | 0.06 | remainder | $\alpha + \beta + \gamma$ | 20 |
| 6080 | 72.6 | 2.3 | 0.5 | 0.15 | 0.23 | 0.11 | 0.02 | | remainder | $\alpha + \beta + \gamma$ | 25 |

TABLE 11

| | alloy composition (wt %) | | | | | | | | | metal construction | |
|---|---|---|---|---|---|---|---|---|---|---|---|
| No. | Cu | Si | Sn | Te | Se | P | Sb | As | Zn | phases | $\gamma + \kappa + \mu$(%) |
| 6081 | 74.2 | 3 | 0.5 | 0.03 | 0.03 | 0.2 | | 0.02 | remainder | $\alpha + \gamma$ | 35 |
| 6082 | 70.6 | 2.2 | 2.6 | 0.32 | 0.05 | | 0.13 | 0.03 | remainder | $\alpha + \beta + \gamma$ | 30 |
| 6083 | 73.7 | 2.6 | 0.8 | 0.14 | 0.16 | 0.06 | 0.02 | 0.03 | remainder | $\alpha + \gamma + \kappa$ | 30 |
| 6084 | 74.5 | 3.1 | | 0.04 | 0.04 | 0.05 | | | remainder | $\alpha + \gamma + \kappa$ | 30 |
| 6085 | 72.8 | 2.7 | | 0.09 | 0.21 | 0.04 | 0.02 | | remainder | $\alpha + \gamma + \kappa$ | 20 |
| 6086 | 76.2 | 3.3 | | 0.03 | 0.04 | 0.11 | | 0.04 | remainder | $\alpha + \gamma + \kappa + \mu$ | 45 |
| 6087 | 73.8 | 2.7 | | 0.11 | 0.03 | 0.02 | 0.04 | 0.03 | remainder | $\alpha + \gamma + \kappa$ | 20 |
| 6088 | 74.9 | 2.9 | | 0.05 | 0.31 | | 0.05 | | remainder | $\alpha + \gamma + \kappa$ | 25 |
| 6089 | 75.8 | 2.8 | | 0.08 | 0.04 | | 0.03 | 0.14 | remainder | $\alpha + \kappa$ | 25 |
| 6090 | 73.6 | 2.4 | | 0.27 | 0.1 | | | 0.06 | remainder | $\alpha + \gamma + \kappa$ | 15 |
| 6091 | 72.4 | 2.2 | 3.2 | | 0.33 | | | | remainder | $\alpha + \beta + \gamma$ | 35 |
| 6092 | 75 | 3.2 | 0.6 | | 0.05 | 0.1 | | | remainder | $\alpha + \gamma$ | 45 |
| 6093 | 76.8 | 3.1 | 0.5 | | 0.04 | | 0.11 | | remainder | $\alpha + \gamma + \kappa$ | 55 |
| 6094 | 74.5 | 2.9 | 0.7 | | 0.08 | | | 0.15 | remainder | $\alpha + \gamma + \kappa$ | 35 |
| 6095 | 73.2 | 2.7 | 1.2 | | 0.12 | 0.06 | 0.03 | | remainder | $\alpha + \gamma$ | 30 |
| 6096 | 69.6 | 2.4 | 2.3 | | 0.14 | 0.04 | | 0.02 | remainder | $\alpha + \beta + \gamma$ | 30 |
| 6097 | 74.2 | 2.8 | 0.8 | | 0.07 | | 0.02 | 0.03 | remainder | $\alpha + \gamma$ | 35 |
| 6098 | 74.4 | 2.9 | 0.8 | | 0.06 | 0.03 | 0.03 | 0.03 | remainder | $\alpha + \gamma$ | 40 |
| 6099 | 74.8 | 3.1 | | | 0.09 | 0.04 | | | remainder | $\alpha + \gamma + \kappa$ | 30 |
| 6100 | 73.9 | 2.8 | | | 0.05 | 0.1 | 0.04 | | remainder | $\alpha + \gamma + \kappa$ | 25 |

TABLE 12

| | alloy composition (wt %) | | | | | | | metal construction | |
|---|---|---|---|---|---|---|---|---|---|
| No. | Cu | Si | Se | P | Sb | As | Zn | phases | $\gamma + \kappa + \mu$(%) |
| 6101 | 76.1 | 3 | 0.04 | 0.05 | | 0.02 | remainder | $\alpha + \gamma + \kappa$ | 30 |
| 6102 | 74.5 | 2.8 | 0.03 | 0.04 | 0.02 | 0.03 | remainder | $\alpha + \gamma + \kappa$ | 25 |
| 6103 | 74.3 | 2.6 | 0.31 | | 0.04 | | remainder | $\alpha + \kappa$ | 20 |

TABLE 12-continued

| | alloy composition (wt %) | | | | | | | metal construction | |
|---|---|---|---|---|---|---|---|---|---|
| No. | Cu | Si | Se | P | Sb | As | Zn | phases | $\gamma + \kappa + \mu$(%) |
| 6104 | 75 | 3.3 | 0.06 | | 0.02 | 0.05 | remainder | $\alpha + \gamma + \kappa$ | 45 |
| 6105 | 73.9 | 2.9 | 0.1 | | | 0.11 | remainder | $\alpha + \gamma + \kappa$ | 25 |

TABLE 13

| | alloy composition (wt %) | | | | | | metal construction | |
|---|---|---|---|---|---|---|---|---|
| No. | Cu | Si | Sn | Mn | Ni | Zn | phases | $\gamma + \kappa + \mu$(%) |
| 7001 | 62.9 | 2.7 | 2.6 | 2.2 | | remainder | $\alpha + \beta + \gamma$ | 10 |
| 7001a | | | | | | | | |
| 7002 | 64.8 | 3.4 | 1.8 | | 3.1 | remainder | $\alpha + \beta + \gamma$ | 20 |
| 7002a | | | | | | | | |
| 7003 | 68.2 | 4.1 | 0.6 | 1.9 | 1.5 | remainder | $\alpha + \beta + \gamma$ | 30 |
| 7003a | | | | | | | | |

TABLE 14

| | alloy composition (wt %) | | | | | | | metal construction | |
|---|---|---|---|---|---|---|---|---|---|
| No. | Cu | Si | Sn | P | Mn | Ni | Zn | phases | $\gamma + \kappa + \mu$(%) |
| 7016 | 68.1 | 4 | 0.4 | 0.04 | 2.8 | | remainder | $\alpha + \beta + \gamma$ | 25 |
| 7016a | | | | | | | | | |
| 7017 | 63.8 | 2.6 | 2.7 | 0.19 | | 0.9 | remainder | $\alpha + \beta + \gamma$ | 20 |
| 7017a | | | | | | | | | |
| 7018 | 66.7 | 3.4 | 1.3 | 0.07 | 1.2 | 0.8 | remainder | $\alpha + \beta + \gamma$ | 25 |
| 7018a | | | | | | | | | |
| 7019 | 67.2 | 3.6 | | 0.21 | 1.9 | | remainder | $\alpha + \beta + \gamma$ | 15 |
| 7019a | | | | | | | | | |
| 7020 | 69.1 | 3.8 | | 0.06 | | 2.2 | remainder | $\alpha + \beta + \gamma + \kappa$ | 25 |
| 7020a | | | | | | | | | |

TABLE 15

| | alloy composition (wt %) | | | | | | | metal construction | |
|---|---|---|---|---|---|---|---|---|---|
| No. | Cu | Si | Sn | P | Mn | Ni | Zn | phases | $\gamma + \kappa + \mu$(%) |
| 7021 | 72.1 | 4.3 | | 0.07 | 2 | 0.8 | remainder | $\alpha + \gamma + \kappa$ | 45 |
| 7021a | | | | | | | | | |

TABLE 15-continued

| | alloy composition (wt %) | | | | | | | metal construction | |
|---|---|---|---|---|---|---|---|---|---|
| No. | Cu | Si | Sn | P | Mn | Ni | Zn | phases | $\gamma + \kappa + \mu$(%) |
| 7030 | 68.4 | 4.2 | 2.6 | | 3.3 | | remainder | $\alpha + \beta + \gamma$ | 35 |
| 7030a | | | | | | | | | |

TABLE 16

| | alloy composition (wt %) | | | | | | | | metal construction | |
|---|---|---|---|---|---|---|---|---|---|---|
| No. | Cu | Si | Sn | Bi | Te | Se | Mn | Zn | phases | $\gamma + \kappa + \mu$(%) |
| 8001<br>8001a | 62.6 | 2.6 | 2.6 | 0.31 | | | 1.9 | remainder | $\alpha + \beta + \gamma$ | 10 |
| 8002<br>8002a | 65.3 | 3.4 | 1.8 | 0.11 | 0.02 | | 2.5 | remainder | $\alpha + \beta + \gamma$ | 20 |
| 8003<br>8003a | 66.4 | 4.2 | 0.5 | 0.05 | | 0.03 | 3.4 | remainder | $\alpha + \beta + \gamma$ | 35 |
| 8004<br>8004a | 72.1 | 4.4 | 0.4 | 0.06 | 0.05 | 0.02 | 2.8 | remainder | $\alpha + \beta + \gamma + \kappa$ | 45 |
| 8005<br>8005a | 67.4 | 3.3 | 2.3 | | 0.31 | | 0.9 | remainder | $\alpha + \beta + \gamma$ | 25 |
| 8006<br>8006a | 63.8 | 2.8 | 2.9 | | 0.06 | 0.07 | 2.1 | remainder | $\alpha + \beta + \gamma$ | 15 |
| 8007<br>8007a | 71.5 | 3.9 | 1.5 | | | 0.2 | 1.4 | remainder | $\alpha + \beta + \gamma$ | 40 |

TABLE 17

| | alloy composition (wt %) | | | | | | | | | metal construction | |
|---|---|---|---|---|---|---|---|---|---|---|---|
| No. | Cu | Si | Sn | Bi | Te | Se | P | Mn | Zn | phases | $\gamma + \kappa + \mu$(%) |
| 8015<br>8015a | 62.8 | 2.6 | 2.9 | 0.12 | | | 0.03 | 1.2 | remainder | $\alpha + \beta + \gamma$ | 10 |
| 8016<br>8016a | 64.4 | 2.9 | 2.7 | 0.23 | 0.09 | | 0.13 | 1.8 | remainder | $\alpha + \beta + \gamma$ | 15 |
| 8017<br>8017a | 68.3 | 3.6 | 0.4 | 0.05 | | 0.05 | 0.04 | 22 | remainder | $\alpha + \beta + \gamma$ | 30 |
| 8018<br>8018a | 73.2 | 4.3 | 0.5 | 0.06 | 0.02 | 0.11 | 0.02 | 3.1 | remainder | $\alpha + + + \kappa$ | 60 |
| 8019<br>8019a | 72.4 | 4.1 | 0.7 | | 0.14 | | 0.21 | 2.1 | remainder | $\alpha + \gamma + \kappa$ | 50 |
| 8020<br>8020a | 69.5 | 3.7 | 0.7 | | 0.06 | 0.04 | 0.05 | 1.9 | remainder | $\alpha + \beta + \gamma + \kappa$ | 35 |

TABLE 18

| | alloy composition (wt %) | | | | | | | metal construction | |
|---|---|---|---|---|---|---|---|---|---|
| No. | Cu | Si | Sn | Se | P | Mn | Zn | phases | $\gamma + \kappa + \mu$(%) |
| 8021<br>8021a | 64.2 | 3.4 | 2.5 | 0.31 | 0.03 | 1.9 | remain-der | $\alpha + \beta + \gamma$ | 15 |

TABLE 19

| | alloy composition (wt %) | | | | | | | | | | metal construction | |
|---|---|---|---|---|---|---|---|---|---|---|---|---|
| No. | Cu | Si | Sn | Bi | Te | Se | P | Mn | Ni | Zn | phases | $\gamma + \kappa + \mu$(%) |
| 8043<br>8043a | 77 | 4.5 | | 0.03 | | | 0.12 | 1.7 | | remainder | $\alpha + \kappa + \mu$ | 55 |
| 8044<br>8044a | 70.6 | 3.9 | | 0.1 | 0.06 | | 0.04 | 2.6 | | remainder | $\alpha + \gamma + \kappa$ | 30 |
| 8045<br>8045a | 74.2 | 4.3 | | 0.11 | | 0.21 | 0.16 | 2.8 | | remainder | $\alpha + \kappa$ | 45 |
| 8046<br>8046a | 69.9 | 3.8 | | 0.06 | 0.11 | 0.03 | 0.08 | 1.2 | | remainder | $\alpha + \beta + \gamma$ | 20 |

TABLE 19-continued

| | alloy composition (wt %) | | | | | | | | | | metal construction | |
|---|---|---|---|---|---|---|---|---|---|---|---|---|
| No. | Cu | Si | Sn | Bi | Te | Se | P | Mn | Ni | Zn | phases | $\gamma + \kappa + \mu$(%) |
| 8047 | 66.8 | 3.4 | | | 0.09 | | 0.06 | 2.2 | | remainder | $\alpha + \beta + \gamma$ | 15 |
| 8047a | | | | | | | | | | | | |
| 8048 | 71.3 | 4.2 | | | 0.04 | 0.05 | 0.05 | 1.4 | | remainder | $\alpha + \beta + \gamma$ | 35 |
| 8048a | | | | | | | | | | | | |
| 8049 | 72.4 | 4.1 | | | | 0.12 | 0.09 | 2.7 | | remainder | $\alpha + \gamma + \kappa$ | 40 |
| 8049a | | | | | | | | | | | | |
| 8050 | 62.9 | 2.8 | 2.8 | 0.12 | | | | | 1.5 | remainder | $\alpha + \beta + \gamma$ | 15 |
| 8050a | | | | | | | | | | | | |

TABLE 20

| | alloy composition (wt %) | | | | | | | | metal construction | |
|---|---|---|---|---|---|---|---|---|---|---|
| No. | Cu | Si | Sn | Bi | Te | Se | Ni | Zn | phases | $\gamma + \kappa + \mu$(%) |
| 8051 | 64.8 | 3.1 | 2.4 | 0.08 | 0.03 | | 2 | remainder | $\alpha + \beta + \gamma$ | 15 |
| 8051a | | | | | | | | | | |
| 8052 | 68.9 | 3.9 | 0.3 | 0.03 | | 0.06 | 1.8 | remainder | $\alpha + \beta + \gamma$ | 30 |
| 8052a | | | | | | | | | | |
| 8053 | 67.3 | 3.7 | 0.7 | 0.05 | 0.04 | 0.04 | 2.1 | remainder | $\alpha + \beta + \gamma$ | 25 |
| 8053a | | | | | | | | | | |
| 8054 | 66.5 | 3.8 | 0.9 | | 0.31 | | 2.2 | remainder | $\alpha + \beta + \gamma$ | 25 |
| 8054a | | | | | | | | | | |
| 8055 | 73.8 | 4.3 | 2.1 | | 0.03 | 0.05 | 3.3 | remainder | $\alpha + \gamma$ | 55 |
| 8055a | | | | | | | | | | |
| 8056 | 74.2 | 4.4 | 1.3 | | | 0.03 | 2.7 | remainder | $\alpha + \gamma$ | 60 |
| 8056a | | | | | | | | | | |

TABLE 21

| | alloy composition (wt %) | | | | | | | | | metal construction | |
|---|---|---|---|---|---|---|---|---|---|---|---|
| No. | Cu | Si | Sn | Bi | Te | Se | P | Ni | Zn | phases | $\gamma + \kappa + \mu$(%) |
| 8064 | 68.2 | 3.6 | 2.6 | 0.04 | | | 0.05 | 1.5 | remainder | $\alpha + \beta + \gamma$ | 25 |
| 8064a | | | | | | | | | | | |
| 8065 | 63.9 | 2.9 | 2.3 | 0.32 | 0.02 | | 0.08 | 0.8 | remainder | $\alpha + \beta + \gamma$ | 15 |
| 8065a | | | | | | | | | | | |
| 8066 | 70.5 | 3.9 | 1.1 | 0.05 | | 0.05 | 0.05 | 2.2 | remainder | $\alpha + \beta + \gamma$ | 35 |
| 8066a | | | | | | | | | | | |
| 8067 | 67.7 | 3.7 | 1.2 | 0.09 | 0.03 | 0.02 | 0.04 | 2 | remainder | $\alpha + \beta + \gamma$ | 30 |
| 8067a | | | | | | | | | | | |
| 8068 | 66.6 | 3.5 | 1.4 | | 0.06 | | 0.04 | 2.6 | remainder | $\alpha + \beta + \gamma$ | 25 |
| 8068a | | | | | | | | | | | |
| 8069 | 72.3 | 4.1 | 0.6 | | 0.05 | 0.04 | 0.1 | 3 | remainder | $\alpha + \gamma + \kappa$ | 45 |
| 8069a | | | | | | | | | | | |
| 8070 | 70.6 | 4 | 0.4 | | | 0.16 | 0.05 | 3.2 | remainder | $\alpha + \gamma$ | 40 |
| 8070a | | | | | | | | | | | |

TABLE 22

| | alloy composition (wt %) | | | | | | | | | | metal construction | |
|---|---|---|---|---|---|---|---|---|---|---|---|---|
| No. | Cu | Si | Sn | Bi | Te | Se | P | Mn | Ni | Zn | phases | $\gamma + \kappa + \mu$(%) |
| 8092 | 67.2 | 3.4 | | 0.05 | | | 0.04 | | 2 | remainder | $\alpha + \beta + \gamma$ | 20 |
| 8092a | | | | | | | | | | | | |
| 8093 | 65.8 | 3.2 | | 0.15 | 0.03 | | 0.06 | | 1.2 | remainder | $\alpha + \beta + \gamma$ | 10 |
| 8093a | | | | | | | | | | | | |
| 8094 | 67.7 | 3.7 | | 0.06 | | 0.1 | 0.08 | | 2.1 | remainder | $\alpha + \beta + \gamma$ | 20 |
| 8094a | | | | | | | | | | | | |

TABLE 22-continued

| | alloy composition (wt %) | | | | | | | | | | metal construction | |
|---|---|---|---|---|---|---|---|---|---|---|---|---|
| No. | Cu | Si | Sn | Bi | Te | Se | P | Mn | Ni | Zn | phases | $\gamma + \kappa + \mu$(%) |
| 8095 | 64.7 | 2.9 | | 0.31 | 0.04 | 0.05 | 0.09 | | 1.5 | remainder | $\alpha + \beta + \gamma$ | 10 |
| 8095a | | | | | | | | | | | | |
| 8096 | 66.5 | 3.6 | | | 0.18 | | 0.21 | | 2.3 | remainder | $\alpha + \beta + \gamma$ | 15 |
| 8096a | | | | | | | | | | | | |
| 8097 | 67.3 | 3.8 | | | 0.08 | 0.05 | 0.12 | | 2.2 | remainder | $\alpha + \beta + \gamma$ | 20 |
| 8097a | | | | | | | | | | | | |
| 8098 | 65.9 | 3.6 | | | | 0.21 | 0.2 | | 2.5 | remainder | $\alpha + \beta + \gamma$ | 10 |
| 8098a | | | | | | | | | | | | |
| 8099 | 64.9 | 3.6 | 0.4 | 0.18 | | | | 0.8 | 2.6 | remainder | $\alpha + \beta + \gamma$ | 15 |
| 8099a | | | | | | | | | | | | |
| 8100 | 67.3 | 3.8 | 1.8 | 0.03 | 0.06 | | | 1.9 | 1 | remainder | $\alpha + \beta + \gamma$ | 30 |
| 8100a | | | | | | | | | | | | |

TABLE 23

| | alloy composition (wt %) | | | | | | | | | metal construction | |
|---|---|---|---|---|---|---|---|---|---|---|---|
| No. | Cu | Si | Sn | Bi | Te | Se | Mn | Ni | Zn | phases | $\gamma + \kappa + \mu$(%) |
| 8101 | 62.9 | 2.9 | 2.4 | 0.2 | | 0.16 | 1.3 | 0.9 | remainder | $\alpha + \beta + \gamma$ | 15 |
| 8101a | | | | | | | | | | | |
| 8102 | 66.3 | 3.4 | 0.5 | 0.04 | 0.04 | 0.05 | 1.5 | 0.8 | remainder | $\alpha + \beta + \gamma$ | 20 |
| 8102a | | | | | | | | | | | |
| 8103 | 65.8 | 3.8 | 2.6 | | 0.03 | | 1.4 | 1.2 | remainder | $\alpha + \beta + \gamma$ | 30 |
| 8103a | | | | | | | | | | | |
| 8104 | 64.7 | 3.6 | 2.7 | | 0.25 | 0.03 | 1.3 | 1.6 | remainder | $\alpha + \beta + \gamma$ | 20 |
| 8104a | | | | | | | | | | | |
| 8105 | 70.4 | 3.9 | 1.8 | | | 0.07 | 1 | 2 | remainder | $\alpha + \beta + \gamma + \kappa$ | 35 |
| 8105a | | | | | | | | | | | |

TABLE 24

| | alloy composition (wt %) | | | | | | | | | | metal construction | |
|---|---|---|---|---|---|---|---|---|---|---|---|---|
| No. | Cu | Si | Sn | Bi | Te | Se | P | Mn | Ni | Zn | phases | $\gamma + \kappa + \mu$(%) |
| 8113 | 72 | 3.9 | 1.1 | 0.25 | | | 0.2 | 2.4 | 0.9 | remainder | $\alpha + \gamma$ | 35 |
| 8113a | | | | | | | | | | | | |
| 8114 | 66.5 | 3.6 | 1.2 | 0.06 | 0.04 | | 0.05 | 1.3 | 1.1 | remainder | $\alpha + \beta + \gamma$ | 25 |
| 8114a | | | | | | | | | | | | |
| 8115 | 67 | 3.5 | 1.3 | 0.12 | | 0.04 | 0.08 | 0.9 | 1.2 | remainder | $\alpha + \beta + \gamma$ | 25 |
| 8115a | | | | | | | | | | | | |
| 8116 | 64 | 2.8 | 2.6 | 0.3 | 0.08 | 0.03 | 0.05 | 0.8 | 1 | remainder | $\alpha + \beta + \gamma$ | 15 |
| 8116a | | | | | | | | | | | | |
| 8117 | 67.3 | 3.7 | 2.3 | | 0.03 | | 0.03 | 1.2 | 1.3 | remainder | $\alpha + \beta + \gamma$ | 30 |
| 8117a | | | | | | | | | | | | |
| 8118 | 66.4 | 3.8 | 2.4 | | 0.05 | 0.15 | 0.03 | 1 | 1.6 | remainder | $\alpha + \beta + \gamma$ | 30 |
| 8118a | | | | | | | | | | | | |
| 8119 | 70.2 | 3.9 | 0.5 | | | 0.3 | 0.07 | 1.7 | 0.9 | remainder | $\alpha + \gamma + \kappa$ | 35 |
| 8119a | | | | | | | | | | | | |

TABLE 25

| | alloy composition (wt %) | | | | | | | | | metal construction | |
|---|---|---|---|---|---|---|---|---|---|---|---|
| No. | Cu | Si | Bi | Te | Se | P | Mn | Ni | Zn | phases | $\gamma + \kappa + \mu$(%) |
| 8141 | 66.5 | 3.6 | 0.05 | | | 0.05 | 1.5 | 1.2 | remainder | $\alpha + \beta + \gamma$ | 20 |
| 8141a | | | | | | | | | | | |
| 8142 | 63.9 | 2.9 | 0.3 | 0.03 | | 0.04 | 1.2 | 0.9 | remainder | $\alpha + \beta + \gamma$ | 10 |
| 8142a | | | | | | | | | | | |
| 8143 | 68.4 | 3.8 | 0.03 | | 0.05 | 0.12 | 0.9 | 2.5 | remainder | $\alpha + \gamma$ | 20 |
| 8143a | | | | | | | | | | | |
| 8144 | 65.8 | 3.4 | 0.1 | 0.05 | 0.02 | 0.03 | 1 | 1.4 | remainder | $\alpha + \beta + \gamma$ | 15 |
| 8144a | | | | | | | | | | | |
| 8145 | 70.5 | 3.9 | | 0.12 | | 0.05 | 2.6 | 0.8 | remainder | $\alpha + \gamma + \kappa$ | 25 |
| 8145a | | | | | | | | | | | |
| 8146 | 72 | 4.2 | | 0.04 | 0.05 | 0.18 | 1 | 2.4 | remainder | $\alpha + \kappa + \mu$ | 35 |
| 8146a | | | | | | | | | | | |

TABLE 25-continued

| | alloy composition (wt %) | | | | | | | | | metal construction | |
|---|---|---|---|---|---|---|---|---|---|---|---|
| No. | Cu | Si | Bi | Te | Se | P | Mn | Ni | Zn | phases | $\gamma + \kappa + \mu$(%) |
| 8147 | 68 | 3.7 | | | 0.2 | 0.06 | 1.5 | 1 | remainder | $\alpha + \beta + \gamma$ | 20 |
| 8147a | | | | | | | | | | | |

TABLE 26

| | alloy composition (wt %) | | | | | metal construction | |
|---|---|---|---|---|---|---|---|
| No. | Cu | Si | Al | P | Zn | phases | $\gamma + \kappa + \mu$(%) |
| 9001 | 72.6 | 2.3 | 0.8 | 0.03 | remainder | $\alpha + \beta + \gamma$ | 15 |
| 9002 | 74.8 | 2.8 | 1.3 | 0.09 | remainder | $\alpha + \gamma$ | 30 |
| 9003 | 77.2 | 3.6 | 0.2 | 0.21 | remainder | $\alpha + \gamma + \kappa$ | 55 |
| 9004 | 75.7 | 3 | 1.1 | 0.07 | remainder | $\alpha + \gamma + \kappa$ | 35 |
| 9005 | 78 | 3.8 | 0.7 | 0.12 | remainder | $\alpha + \kappa + \mu$ | 65 |

TABLE 27

| | alloy composition (wt %) | | | | | | | metal construction | |
|---|---|---|---|---|---|---|---|---|---|
| No. | Cu | Si | Al | P | Cr | Ti | Zn | phases | $\gamma + \kappa + \mu$(%) |
| 10001 | 74.3 | 2.9 | 0.6 | 0.05 | | 0.03 | remainder | $\alpha + \gamma + \kappa$ | 25 |
| 10002 | 74.8 | 3 | 0.2 | 0.12 | | 0.32 | remainder | $\alpha + \gamma + \kappa$ | 30 |
| 10003 | 74.9 | 2.8 | 0.9 | 0.08 | 0.33 | | remainder | $\alpha + \gamma + \kappa$ | 30 |
| 10004 | 77.8 | 3.6 | 1.2 | 0.22 | 0.08 | | remainder | $\alpha + \gamma + \kappa$ | 55 |
| 10005 | 71.9 | 2.3 | 1.4 | 0.07 | 0.02 | 0.24 | remainder | $\alpha + \beta + \gamma$ | 20 |
| 10006 | 76 | 2.8 | 1.2 | 0.03 | | 0.15 | remainder | $\alpha + \gamma + \kappa$ | 30 |
| 10007 | 75.5 | 3 | 0.3 | 0.06 | 0.2 | | remainder | $\alpha + \gamma + \kappa$ | 35 |
| 10008 | 71.5 | 2.2 | 0.7 | 0.12 | 0.14 | 0.05 | remainder | $\alpha + \gamma$ | 20 |

TABLE 28

| | alloy composition (wt %) | | | | | | | | metal construction | |
|---|---|---|---|---|---|---|---|---|---|---|
| No. | Cu | Si | Al | P | Bi | Te | Se | Zn | phases | $\gamma + \kappa + \mu$(%) |
| 11001 | 74.8 | 2.8 | 1.4 | 0.1 | 0.03 | | | remainder | $\alpha + \gamma$ | 35 |
| 11002 | 76.1 | 3 | 0.6 | 0.06 | | 0.21 | | remainder | $\alpha + \gamma + \kappa$ | 40 |
| 11003 | 78.3 | 3.5 | 1.3 | 0.19 | | | 0.18 | remainder | $\alpha + \gamma + \kappa$ | 60 |
| 11004 | 71.7 | 2.4 | 0.8 | 0.04 | 0.21 | 0.03 | | remainder | $\alpha + \beta + \gamma$ | 25 |
| 11005 | 73.9 | 2.8 | 0.3 | 0.09 | 0.33 | | 0.03 | remainder | $\alpha + \gamma$ | 25 |
| 11006 | 74.8 | 2.8 | 0.7 | 0.11 | | 0.16 | 0.02 | remainder | $\alpha + \gamma + \kappa$ | 30 |
| 11007 | 78.3 | 3.8 | 1.1 | 0.05 | 0.22 | 0.05 | 0.04 | remainder | $\alpha + \gamma + \kappa + \mu$ | 65 |

TABLE 29

| | alloy composition (wt %) | | | | | | | | | | metal construction | |
|---|---|---|---|---|---|---|---|---|---|---|---|---|
| No. | Cu | Si | Al | Bi | Te | Se | P | Cr | Ti | Zn | phases | $\gamma + \kappa + \mu$(%) |
| 12001 | 73.8 | 2.6 | 0.5 | 0.21 | | | 0.05 | 0.11 | | remainder | $\alpha + \gamma$ | 25 |
| 12002 | 76.5 | 3.2 | 0.9 | | 0.03 | | 0.11 | 0.03 | | remainder | $\alpha + \gamma + \kappa$ | 40 |
| 12003 | 78.1 | 3.4 | 1.3 | | | 0.09 | 0.2 | 0.05 | | remainder | $\alpha + \kappa + \mu$ | 55 |
| 12004 | 70.8 | 2.1 | 0.6 | 0.22 | 0.06 | | 0.08 | 0.32 | | remainder | $\alpha + \beta + \gamma$ | 20 |
| 12005 | 77.8 | 3.8 | 0.2 | 0.02 | | 0.03 | 0.03 | 0.26 | | remainder | $\alpha + \kappa + \mu$ | 65 |
| 12006 | 74.6 | 2.9 | 0.7 | | 0.15 | 0.02 | 0.1 | 0.06 | | remainder | $\alpha + \gamma + \kappa$ | 30 |
| 12007 | 73.9 | 2.8 | 0.3 | 0.04 | 0.05 | 0.16 | 0.03 | 0.18 | | remainder | $\alpha + \gamma$ | 25 |
| 12008 | 75.7 | 2.9 | 1.2 | 0.03 | | | 0.12 | | 0.05 | remainder | $\alpha + \gamma + \kappa$ | 35 |
| 12009 | 72.9 | 2.6 | 0.5 | | 0.33 | | 0.04 | | 0.12 | remainder | $\alpha + \beta + \gamma$ | 20 |

TABLE 29-continued

| | alloy composition (wt %) | | | | | | | | | | metal construction | |
|---|---|---|---|---|---|---|---|---|---|---|---|---|
| No. | Cu | Si | Al | Bi | Te | Se | P | Cr | Ti | Zn | phases | $\gamma + \kappa + \mu$(%) |
| 12010 | 76.5 | 3.2 | 0.3 | | | 0.32 | 0.03 | | 0.35 | remainder | $\alpha + \kappa + \mu$ | 40 |
| 12011 | 71.9 | 2.5 | 0.8 | 0.19 | 0.03 | | 0.03 | | 0.03 | remainder | $\alpha + \beta + \gamma$ | 25 |
| 12012 | 74.7 | 2.9 | 0.6 | 0.07 | | 0.05 | 0.21 | | 0.06 | remainder | $\alpha + \gamma + \kappa$ | 30 |
| 12013 | 74.8 | 2.8 | 1.3 | | 0.04 | 021 | 0.06 | | 0.26 | remainder | $\alpha + \gamma + \kappa$ | 35 |
| 12014 | 78.2 | 3.8 | 1.1 | 0.22 | 0.05 | 0.03 | 0.04 | | 0.24 | remainder | $\alpha + \gamma$ | 60 |
| 12015 | 74.6 | 2.7 | 1 | 0.15 | | | 0.03 | 0.02 | 0.1 | remainder | $\alpha + \gamma + \kappa + \mu$ | 30 |
| 12016 | 75.5 | 2.9 | 0.7 | | 0.22 | | 0.05 | 0.34 | 0.02 | remainder | $\alpha + \gamma$ | 35 |
| 12017 | 76.2 | 3.4 | 0.3 | | | 0.05 | 0.12 | 0.08 | 0.31 | remainder | $\alpha + \gamma + \kappa$ | 50 |
| 12018 | 77 | 3.3 | 1.1 | 0.03 | 0.14 | | 0.03 | 0.05 | 0.03 | remainder | $\alpha + \kappa$ | 50 |
| 12019 | 73.7 | 2.8 | 0.3 | 0.32 | | 0.03 | 0.1 | 0.03 | 0.19 | remainder | $\alpha + \gamma + \kappa$ | 25 |
| 12020 | 74.8 | 2.8 | 1.2 | | 0.02 | 0.14 | 0.05 | 0.14 | 0.05 | remainder | $\alpha + \gamma$ | 35 |
| 12021 | 74 | 2.9 | 0.4 | 0.07 | 0.05 | 0.05 | 0.08 | 0.11 | 0.26 | remainder | $\alpha + \gamma + \kappa$ | 25 |

TABLE 30

| | alloy composition (wt %) | | | heat treatment | | metal construction | |
|---|---|---|---|---|---|---|---|
| No. | Cu | Si | Zn | temperature | time | phases | $\gamma + \kappa + \mu$(%) |
| 13001 | 78.5 | 3.2 | remainder | 580° C. | 30 min. | $\alpha + \gamma + \kappa$ | 45 |
| 13002 | 78.5 | 3.2 | remainder | 450° C. | 2 hr. | $\alpha + \gamma + \kappa + \mu$ | 45 |
| 13003 | 77 | 2.9 | remainder | 580° C. | 30 min. | $\alpha + \gamma + \kappa$ | 35 |
| 13004 | 77 | 2.9 | remainder | 450° C. | 2 hr. | $\alpha + \gamma + \kappa + \mu$ | 35 |
| 13005 | 69.9 | 2.3 | remainder | 580° C. | 30 min. | $\alpha + \gamma + \kappa$ | 20 |
| 13006 | 69.9 | 2.3 | remainder | 450° C. | 2 hr. | $\alpha + \gamma + \kappa + \mu$ | 20 |

TABLE 31

| | alloy composition (wt %) | | | | | | | | | metal construction |
|---|---|---|---|---|---|---|---|---|---|---|
| No. | Cu | Si | Sn | Al | Mn | Pb | Fe | Ni | Zn | phases |
| 14001 | 58.8 | | 0.2 | | | 3.1 | 0.2 | | remainder | $\alpha + \beta$ |
| 14001a | | | | | | | | | | |
| 14002 | 61.4 | | 0.2 | | | 3 | 0.2 | | remainder | $\alpha + \beta$ |
| 14002a | | | | | | | | | | |
| 14003 | 59.1 | | 0.2 | | | 2 | 0.2 | | remainder | $\alpha + \beta$ |
| 14003a | | | | | | | | | | |
| 14004 | 69.2 | 1.2 | | | | 0.1 | | | remainder | $\alpha + \beta$ |
| 14004a | | | | | | | | | | |
| 14005 | remainder | | | 9.8 | 1.1 | | 3.9 | 1.2 | | $\alpha + \beta$ |
| 14005a | | | | | | | | | | |

TABLE 32

| | machinability | | | corrosion resistance | hot | mechanical properties | | stress resistance |
|---|---|---|---|---|---|---|---|---|
| No. | form of chippings | condition of cut surface | cutting force (N) | maximum depth of corrosion ($\mu$m) | workability 700° C. deform ability | tensile strength (N/mm$^2$) | elongation (%) | corrosion cracking resistance |
| 1001 | ◎ | ○ | 118 | 190 | ○ | 575 | 32 | ○ |
| 1002 | ◎ | ○ | 123 | 180 | ○ | 575 | 35 | ○ |
| 1003 | ◎ | ○ | 119 | 190 | ○ | 543 | 34 | ○ |
| 1004 | ◎ | ○ | 126 | 170 | Δ | 590 | 37 | ○ |
| 1005 | Δ | ○ | 134 | 150 | Δ | 532 | 42 | ○ |

TABLE 33

| | machinability | | | corrosion resistance | hot | mechanical properties | | stress resistance |
|---|---|---|---|---|---|---|---|---|
| No. | form of chippings | condition of cut surface | cutting force (N) | maximum depth of corrosion (μm) | workability 700° C. deform ability | tensile strength (N/mm$^2$) | elongation (%) | corrosion cracking resistance |
| 2001 | 75.2 | 3.2 | | | 0.19 | remainder | α + γ + κ | 40 |
| 2002 | 72.6 | 3.1 | | 0.25 | | remainder | α + β + γ | 30 |
| 2003 | 77.6 | 3.8 | 0.05 | 0.09 | | remainder | α + κ + μ | 65 |
| 2004 | 75.8 | 3.5 | 0.11 | | 0.05 | remainder | α + κ + μ | 55 |
| 2005 | 76.4 | 3.4 | 0.03 | 0.05 | 0.11 | remainder | α + κ + μ | 50 |
| 2006 | ⊚ | ○ | 119 | 170 | Δ | 552 | 36 | ○ |
| 2008 | ⊚ | ○ | 115 | 140 | Δ | 570 | 34 | ○ |

TABLE 34

| | machinability | | | corrosion resistance | hot | mechanical properties | | stress resistance |
|---|---|---|---|---|---|---|---|---|
| No. | form of chippings | condition of cut surface | cutting force (N) | maximum depth of corrosion (μm) | workability 700° C. deform ability | tensile strength (N/mm$^2$) | elongation (%) | corrosion cracking resistance |
| 3001 | ⊚ | Δ | 128 | 40 | ○ | 553 | 26 | ○ |
| 3004 | ⊚ | ○ | 119 | <5 | ○ | 533 | 36 | ○ |
| 3005 | ⊚ | ○ | 125 | 50 | ○ | 525 | 28 | ○ |
| 3008 | ⊚ | ○ | 122 | 80 | ○ | 570 | 36 | ○ |
| 3009 | ⊚ | ○ | 123 | 50 | ○ | 541 | 29 | ○ |
| 3010 | ⊚ | ○ | 118 | <5 | ○ | 560 | 35 | ○ |
| 3011 | ⊚ | ○ | 119 | 20 | ○ | 502 | 34 | ○ |
| 3012 | ⊚ | ○ | 120 | <5 | ○ | 534 | 31 | ○ |

TABLE 35

| | machinability | | | corrosion resistance | hot | mechanical properties | | stress resistance |
|---|---|---|---|---|---|---|---|---|
| No. | form of chippings | condition of cut surface | cutting force (N) | maximum depth of corrosion (μm) | workability 700° C. deform ability | tensile strength (N/mm$^2$) | elongation (%) | corrosion cracking resistance |
| 4001 | ⊚ | ○ | 119 | 40 | Δ | 512 | 24 | ○ |
| 4002 | ⊚ | ○ | 122 | 50 | ○ | 543 | 30 | ○ |
| 4003 | ⊚ | ○ | 123 | 50 | ○ | 533 | 30 | ○ |
| 4004 | ⊚ | ○ | 117 | 80 | Δ | 520 | 31 | ○ |
| 4005 | ⊚ | ○ | 119 | 50 | ○ | 535 | 32 | ○ |
| 4006 | ⊚ | ○ | 116 | 60 | ○ | 532 | 31 | ○ |
| 4007 | ⊚ | ○ | 122 | 50 | ○ | 528 | 26 | ○ |

TABLE 36

| | machinability | | | corrosion resistance | hot | mechanical properties | | stress resistance |
|---|---|---|---|---|---|---|---|---|
| No. | form of chippings | condition of cut surface | cutting force (N) | maximum depth of corrosion (μm) | workability 700° C. deform ability | tensile strength (N/mm$^2$) | elongation (%) | corrosion cracking resistance |
| 4022 | ⊚ | ○ | 123 | <5 | ○ | 487 | 32 | Δ |
| 4023 | ⊚ | ○ | 117 | <5 | ○ | 524 | 34 | ○ |
| 4024 | ⊚ | ○ | 117 | 40 | ○ | 541 | 37 | ○ |
| 4025 | ⊚ | ○ | 115 | <5 | Δ | 526 | 43 | ○ |
| 4026 | ⊚ | ○ | 122 | 30 | ○ | 498 | 30 | Δ |
| 4027 | ⊚ | ○ | 118 | 30 | ○ | 516 | 35 | ○ |
| 4028 | ⊚ | ○ | 120 | <5 | ○ | 529 | 27 | ○ |
| 4029 | ⊚ | ○ | 121 | <5 | ○ | 544 | 28 | ○ |
| 4030 | ⊚ | ○ | 118 | <5 | ○ | 536 | 30 | ○ |
| 4031 | ⊚ | ○ | 116 | <5 | ○ | 524 | 31 | ○ |
| 4032 | ⊚ | ○ | 114 | <5 | ○ | 515 | 32 | ○ |
| 4033 | ⊚ | ○ | 118 | <5 | ○ | 519 | 37 | ○ |

TABLE 36-continued

| | machinability | | | corrosion resistance | hot | mechanical properties | | stress resistance |
|---|---|---|---|---|---|---|---|---|
| No. | form of chippings | condition of cut surface | cutting force (N) | maximum depth of corrosion (μm) | workability 700° C. deform ability | tensile strength (N/mm$^2$) | elongation (%) | corrosion cracking resistance |
| 4034 | ◎ | ○ | 118 | <5 | ○ | 582 | 31 | ○ |
| 4035 | ◎ | ○ | 117 | <5 | ○ | 538 | 32 | ○ |

TABLE 37

| | machinability | | | corrosion resistance | hot | mechanical properties | | stress resistance |
|---|---|---|---|---|---|---|---|---|
| No. | form of chippings | condition of cut surface | cutting force (N) | maximum depth of corrosion (μm) | workability 700° C. deform ability | tensile strength (N/mm$^2$) | elongation (%) | corrosion cracking resistance |
| 5001 | ◎ | Δ | 127 | 30 | ○ | 501 | 25 | ○ |
| 5002 | ◎ | ○ | 119 | <5 | ○ | 524 | 37 | ○ |
| 5003 | ◎ | ○ | 135 | 10 | ○ | 488 | 41 | ○ |
| 5004 | ◎ | ○ | 126 | 20 | Δ | 552 | 38 | ○ |
| 5005 | ◎ | ○ | 123 | <5 | ○ | 518 | 29 | ○ |
| 5006 | ◎ | ○ | 122 | <5 | ○ | 520 | 34 | ○ |
| 5007 | ◎ | ○ | 125 | <5 | ○ | 507 | 23 | ○ |
| 5008 | ◎ | ○ | 122 | <5 | ○ | 515 | 30 | ○ |
| 5009 | ◎ | ○ | 124 | <5 | ○ | 544 | 35 | ○ |
| 5010 | ◎ | ○ | 123 | <5 | Δ | 536 | 36 | ○ |
| 5011 | ◎ | ○ | 126 | <5 | ○ | 511 | 27 | ○ |
| 5012 | ◎ | ○ | 124 | <5 | ○ | 596 | 36 | ○ |
| 5013 | ◎ | ○ | 119 | <5 | ○ | 519 | 39 | ○ |
| 5014 | ◎ | ○ | 122 | <5 | ○ | 523 | 37 | ○ |
| 5015 | ◎ | ○ | 123 | <5 | ○ | 510 | 40 | ○ |
| 5016 | ◎ | ○ | 120 | 20 | ○ | 490 | 35 | Δ |
| 5017 | ◎ | ○ | 121 | <5 | ○ | 573 | 40 | ○ |
| 5018 | ◎ | ○ | 120 | <5 | ○ | 549 | 39 | ○ |
| 5019 | ◎ | ○ | 122 | 50 | ○ | 537 | 30 | ○ |
| 5020 | ◎ | ○ | 118 | <5 | ○ | 521 | 37 | ○ |

TABLE 38

| | machinability | | | corrosion resistance | hot | mechanical properties | | stress resistance |
|---|---|---|---|---|---|---|---|---|
| No. | form of chippings | condition of cut surface | cutting force (N) | maximum depth of corrosion (μm) | workability 700° C. deform ability | tensile strength (N/mm$^2$) | elongation (%) | corrosion cracking resistance |
| 6001 | ◎ | ○ | 121 | 30 | ○ | 512 | 24 | ○ |
| 6002 | ◎ | ○ | 122 | <5 | ○ | 574 | 31 | ○ |
| 6003 | ◎ | ○ | 117 | <5 | Δ | 501 | 32 | ○ |
| 6004 | ◎ | ○ | 120 | <5 | ○ | 514 | 26 | ○ |
| 6005 | ◎ | ○ | 121 | <5 | Δ | 525 | 42 | ○ |
| 6006 | ○ | ○ | 115 | <5 | ○ | 514 | 32 | ○ |
| 6007 | ◎ | ○ | 120 | <5 | ○ | 548 | 27 | ○ |
| 6008 | ◎ | ○ | 119 | <5 | ○ | 503 | 30 | ○ |
| 6009 | ◎ | ○ | 117 | <5 | ○ | 522 | 38 | ○ |
| 6010 | ◎ | ○ | 122 | <5 | Δ | 527 | 41 | ○ |
| 6011 | ◎ | ○ | 119 | <5 | ○ | 536 | 32 | ○ |
| 6012 | ◎ | ○ | 123 | 20 | ○ | 478 | 27 | Δ |
| 6013 | ◎ | ○ | 118 | <5 | ○ | 506 | 30 | ○ |
| 6014 | ◎ | ○ | 118 | <5 | ○ | 525 | 39 | ○ |
| 6015 | ○ | ○ | 114 | <5 | ○ | 503 | 35 | ○ |
| 6016 | ◎ | ○ | 122 | 40 | ○ | 526 | 27 | ○ |
| 6017 | ◎ | ○ | 119 | <5 | Δ | 507 | 30 | ○ |
| 6018 | ◎ | ○ | 121 | <5 | ○ | 589 | 31 | ○ |
| 6019 | ◎ | ○ | 120 | <5 | ○ | 508 | 25 | ○ |
| 6020 | ◎ | ○ | 121 | <5 | Δ | 504 | 43 | ○ |

TABLE 39

| No. | machinability: form of chippings | machinability: condition of cut surface | machinability: cutting force (N) | corrosion resistance: maximum depth of corrosion (μm) | hot workability 700° C. deform ability | mechanical properties: tensile strength (N/mm²) | mechanical properties: elongation (%) | stress resistance: corrosion cracking resistance |
|---|---|---|---|---|---|---|---|---|
| 6021 | ◎ | ○ | 116 | <5 | ○ | 501 | 33 | ○ |
| 6022 | ◎ | ○ | 120 | <5 | ○ | 547 | 29 | ○ |
| 6023 | ◎ | ○ | 119 | <5 | ○ | 523 | 30 | ○ |
| 6024 | ◎ | ○ | 120 | <5 | Δ | 525 | 40 | ○ |
| 6025 | ◎ | ○ | 120 | <5 | ○ | 496 | 30 | ○ |
| 6026 | ○ | ○ | 114 | <5 | ○ | 518 | 34 | ○ |
| 6027 | ◎ | ○ | 119 | <5 | ○ | 487 | 28 | Δ |
| 6028 | ◎ | ○ | 118 | <5 | ○ | 524 | 35 | ○ |
| 6029 | ◎ | ○ | 122 | <5 | Δ | 540 | 41 | ○ |
| 6030 | ◎ | ○ | 118 | <5 | ○ | 511 | 29 | ○ |
| 6031 | ◎ | ○ | 119 | 40 | ○ | 519 | 28 | ○ |
| 6032 | ◎ | ○ | 120 | <5 | ○ | 572 | 32 | ○ |
| 6033 | ◎ | ○ | 123 | <5 | Δ | 515 | 36 | ○ |
| 6034 | ◎ | ○ | 122 | <5 | ○ | 580 | 35 | ○ |
| 6035 | ◎ | ○ | 123 | <5 | ○ | 517 | 27 | ○ |
| 6036 | ◎ | ○ | 121 | <5 | ○ | 503 | 26 | ○ |
| 6037 | ○ | ○ | 117 | <5 | ○ | 536 | 30 | ○ |
| 6038 | ◎ | ○ | 116 | <5 | ○ | 506 | 30 | ○ |
| 6039 | ◎ | ○ | 120 | <5 | ○ | 485 | 28 | Δ |
| 6040 | ○ | ○ | 116 | <5 | ○ | 528 | 36 | ○ |

TABLE 40

| No. | machinability: form of chippings | machinability: condition of cut surface | machinability: cutting force (N) | corrosion resistance: maximum depth of corrosion (μm) | hot workability 700° C. deform ability | mechanical properties: tensile strength (N/mm²) | mechanical properties: elongation (%) | stress resistance: corrosion cracking resistance |
|---|---|---|---|---|---|---|---|---|
| 6041 | ◎ | ○ | 117 | <5 | ○ | 496 | 30 | ○ |
| 6042 | ◎ | ○ | 120 | <5 | Δ | 574 | 34 | ○ |
| 6043 | ◎ | ○ | 123 | 10 | Δ | 506 | 43 | ○ |
| 6044 | ◎ | ○ | 115 | 10 | ○ | 500 | 30 | ○ |
| 6045 | ◎ | ○ | 119 | 20 | Δ | 485 | 27 | Δ |
| 6046 | ◎ | ○ | 121 | 40 | ○ | 512 | 24 | ○ |
| 6047 | ◎ | ○ | 123 | <5 | ○ | 557 | 25 | ○ |
| 6048 | ◎ | ○ | 120 | <5 | ○ | 526 | 30 | ○ |
| 6049 | ◎ | ○ | 120 | <5 | ○ | 502 | 24 | ○ |
| 6050 | ◎ | ○ | 124 | <5 | ○ | 480 | 31 | ○ |
| 6051 | ○ | ○ | 117 | <5 | ○ | 534 | 32 | ○ |
| 6052 | ◎ | ○ | 123 | <5 | Δ | 523 | 38 | ○ |
| 6053 | ◎ | ○ | 123 | <5 | ○ | 506 | 39 | ○ |
| 6054 | ◎ | ○ | 115 | <5 | ○ | 485 | 31 | ○ |
| 6055 | ◎ | ○ | 122 | <5 | Δ | 512 | 44 | ○ |
| 6056 | ◎ | ○ | 120 | <5 | ○ | 480 | 33 | Δ |
| 6057 | ◎ | ○ | 121 | <5 | ○ | 419 | 25 | Δ |
| 6058 | ○ | ○ | 116 | <5 | ○ | 525 | 34 | ○ |
| 6059 | ◎ | ○ | 119 | 20 | ○ | 482 | 35 | ○ |
| 6060 | ○ | ○ | 118 | 30 | ○ | 513 | 38 | ○ |

TABLE 41

| No. | machinability: form of chippings | machinability: condition of cut surface | machinability: cutting force (N) | corrosion resistance: maximum depth of corrosion (μm) | hot workability 700° C. deform ability | mechanical properties: tensile strength (N/mm²) | mechanical properties: elongation (%) | stress resistance: corrosion cracking resistance |
|---|---|---|---|---|---|---|---|---|
| 6061 | ◎ | ○ | 123 | 30 | ○ | 530 | 22 | ○ |
| 6062 | ◎ | ○ | 119 | 10 | ○ | 538 | 33 | ○ |
| 6063 | ◎ | ○ | 118 | <5 | ○ | 504 | 37 | ○ |
| 6064 | ◎ | ○ | 121 | <5 | ○ | 526 | 30 | ○ |
| 6065 | ◎ | ○ | 123 | <5 | ○ | 565 | 35 | ○ |
| 6066 | ◎ | ○ | 120 | <5 | ○ | 501 | 25 | ○ |
| 6067 | ◎ | ○ | 119 | <5 | ○ | 526 | 26 | ○ |

TABLE 41-continued

| No. | machinability: form of chippings | machinability: condition of cut surface | machinability: cutting force (N) | corrosion resistance: maximum depth of corrosion (μm) | hot workability: 700° C. deform ability | mechanical properties: tensile strength (N/mm²) | mechanical properties: elongation (%) | stress resistance: corrosion cracking resistance |
|---|---|---|---|---|---|---|---|---|
| 6068 | ◎ | ○ | 122 | <5 | ○ | 502 | 30 | ○ |
| 6069 | ◎ | ○ | 124 | <5 | ○ | 484 | 28 | Δ |
| 6070 | ○ | ○ | 115 | <5 | ○ | 548 | 37 | ○ |
| 6071 | ◎ | ○ | 118 | <5 | ○ | 530 | 34 | ○ |
| 6072 | ◎ | ○ | 119 | <5 | ○ | 515 | 30 | ○ |
| 6073 | ◎ | ○ | 121 | <5 | Δ | 579 | 35 | ○ |
| 6074 | ◎ | ○ | 117 | <5 | ○ | 517 | 32 | ○ |
| 6075 | ◎ | ○ | 117 | <5 | ○ | 513 | 38 | ○ |
| 6076 | ◎ | ○ | 122 | 40 | ○ | 535 | 28 | ○ |
| 6077 | ○ | ○ | 119 | <5 | ○ | 490 | 30 | ○ |
| 6078 | ◎ | ○ | 122 | <5 | Δ | 513 | 40 | ○ |
| 6079 | ◎ | ○ | 118 | <5 | ○ | 524 | 30 | ○ |
| 6080 | ◎ | ○ | 123 | <5 | ○ | 482 | 35 | ○ |

TABLE 42

| No. | machinability: form of chippings | machinability: condition of cut surface | machinability: cutting force (N) | corrosion resistance: maximum depth of corrosion (μm) | hot workability: 700° C. deform ability | mechanical properties: tensile strength (N/mm²) | mechanical properties: elongation (%) | stress resistance: corrosion cracking resistance |
|---|---|---|---|---|---|---|---|---|
| 6081 | ◎ | ○ | 118 | <5 | ○ | 536 | 34 | ○ |
| 6082 | ◎ | ○ | 123 | <5 | ○ | 510 | 25 | ○ |
| 6083 | ◎ | ○ | 119 | <5 | ○ | 504 | 32 | ○ |
| 6084 | ◎ | ○ | 117 | <5 | ○ | 533 | 34 | ○ |
| 6085 | ◎ | ○ | 118 | 10 | ○ | 501 | 30 | ○ |
| 6086 | ◎ | ○ | 117 | <5 | ○ | 545 | 37 | ○ |
| 6087 | ◎ | ○ | 119 | <5 | ○ | 503 | 34 | ○ |
| 6088 | ○ | ○ | 115 | <5 | ○ | 526 | 36 | ○ |
| 6089 | ◎ | ○ | 119 | <5 | ○ | 514 | 39 | ○ |
| 6090 | ◎ | ○ | 121 | 20 | Δ | 480 | 35 | ○ |
| 6091 | ◎ | ○ | 122 | 30 | ○ | 516 | 24 | ○ |
| 6092 | ◎ | ○ | 118 | <5 | ○ | 532 | 30 | ○ |
| 6093 | ◎ | ○ | 119 | <5 | ○ | 539 | 34 | ○ |
| 6094 | ○ | ○ | 117 | <5 | ○ | 528 | 32 | ○ |
| 6095 | ◎ | ○ | 119 | <5 | ○ | 507 | 30 | ○ |
| 6096 | ◎ | ○ | 122 | <5 | ○ | 508 | 22 | ○ |
| 6097 | ◎ | ○ | 117 | <5 | ○ | 510 | 31 | ○ |
| 6098 | ◎ | ○ | 117 | <5 | ○ | 527 | 32 | ○ |
| 6099 | ◎ | ○ | 116 | <5 | ○ | 529 | 34 | ○ |
| 6100 | ◎ | ○ | 119 | <5 | ○ | 515 | 32 | ○ |

TABLE 43

| No. | machinability: form of chippings | machinability: condition of cut surface | machinability: cutting force (N) | corrosion resistance: maximum depth of corrosion (μm) | hot workability: 700° C. deform ability | mechanical properties: tensile strength (N/mm²) | mechanical properties: elongation (%) | stress resistance: corrosion cracking resistance |
|---|---|---|---|---|---|---|---|---|
| 6101 | ○ | ○ | 115 | <5 | ○ | 530 | 38 | ○ |
| 6102 | ◎ | ○ | 118 | <5 | ○ | 512 | 36 | ○ |
| 6103 | ◎ | ○ | 119 | <5 | ○ | 501 | 35 | ○ |
| 6104 | ◎ | ○ | 117 | <5 | ○ | 535 | 32 | ○ |
| 6105 | ◎ | ○ | 117 | <5 | ○ | 517 | 37 | ○ |

TABLE 44

| | machinability | | | hot work-ability | mechanical properties | |
|---|---|---|---|---|---|---|
| No. | form of chippings | condition of cut surface | cutting force (N) | 700° C. deform-ability | tensile strength (N/mm$^2$) | elong-ation (%) |
| 7001 | ⊙ | Δ | 138 | ○ | 670 | 18 |
| 7002 | ⊙ | Δ | 136 | ○ | 712 | 20 |
| 7003 | ⊙ | ○ | 132 | ○ | 783 | 23 |
| 7016 | ⊙ | ○ | 129 | ○ | 759 | 20 |
| 7017 | Δ | ○ | 139 | ○ | 638 | 18 |
| 7018 | ⊙ | ○ | 135 | ○ | 717 | 20 |
| 7019 | ⊙ | ○ | 136 | ○ | 694 | 24 |
| 7020 | Δ | ○ | 138 | ○ | 712 | 25 |

TABLE 45

| | machinability | | | hot work-ability | mechanical properties | |
|---|---|---|---|---|---|---|
| No. | form of chippings | condition of cut surface | cutting force (N) | 700° C. deform-ability | tensile strength (N/mm$^2$) | elong-ation (%) |
| 7021 | ⊙ | ○ | 130 | ○ | 754 | 24 |
| 7030 | ⊙ | ○ | 135 | ○ | 820 | 18 |

TABLE 46

| | machinability | | | hot work-ability | mechanical properties | |
|---|---|---|---|---|---|---|
| No. | form of chippings | condition of cut surface | cutting force (N) | 700° C. deform-ability | tensile strength (N/mm$^2$) | elong-ation (%) |
| 8001 | ⊙ | ○ | 132 | ○ | 655 | 15 |
| 8002 | ⊙ | ○ | 129 | ○ | 708 | 17 |
| 8003 | ⊙ | ○ | 127 | ○ | 768 | 20 |
| 8004 | ⊙ | ○ | 128 | ○ | 785 | 18 |
| 8005 | ⊙ | ○ | 131 | ○ | 714 | 16 |
| 8006 | ⊙ | ○ | 134 | ○ | 680 | 16 |
| 8007 | ⊙ | ○ | 132 | ○ | 764 | 17 |
| 8015 | ⊙ | ○ | 133 | ○ | 679 | 15 |
| 8016 | ⊙ | ○ | 130 | ○ | 706 | 16 |
| 8017 | ⊙ | ○ | 129 | ○ | 707 | 18 |
| 8018 | ⊙ | ○ | 131 | ○ | 780 | 16 |
| 8019 | ⊙ | ○ | 128 | ○ | 768 | 16 |
| 8020 | ⊙ | ○ | 132 | ○ | 723 | 19 |

TABLE 47

| | machinability | | | hot work-ability | mechanical properties | |
|---|---|---|---|---|---|---|
| No. | form of chippings | condition of cut surface | cutting force (N) | 700° C. deform-ability | tensile strength (N/mm$^2$) | elong-ation (%) |
| 8021 | ⊙ | ○ | 134 | ○ | 765 | 16 |

TABLE 48

| | machinability | | | hot work-ability | mechanical properties | |
|---|---|---|---|---|---|---|
| No. | form of chippings | condition of cut surface | cutting force (N) | 700° C. deform-ability | tensile strength (N/mm$^2$) | elong-ation (%) |
| 8043 | ⊙ | ○ | 131 | ○ | 780 | 18 |
| 8044 | ⊙ | ○ | 126 | ○ | 726 | 21 |
| 8045 | ⊙ | ○ | 128 | ○ | 766 | 22 |
| 8046 | ⊙ | ○ | 127 | ○ | 712 | 23 |
| 8047 | ⊙ | ○ | 128 | ○ | 674 | 21 |
| 8048 | ⊙ | ○ | 129 | ○ | 753 | 24 |
| 8049 | ⊙ | ○ | 127 | ○ | 768 | 22 |
| 8050 | ⊙ | ○ | 132 | ○ | 691 | 17 |
| 8051 | ⊙ | ○ | 131 | ○ | 717 | 17 |
| 8053 | ⊙ | ○ | 128 | ○ | 730 | 22 |
| 8054 | ⊙ | ○ | 127 | ○ | 735 | 20 |
| 8055 | ⊙ | ○ | 134 | ○ | 818 | 15 |
| 8056 | ⊙ | ○ | 132 | ○ | 812 | 16 |

TABLE 49

| | machinability | | | hot work-ability | mechanical properties | |
|---|---|---|---|---|---|---|
| No. | form of chippings | condition of cut surface | cutting force (N) | 700° C. deform-ability | tensile strength (N/mm$^2$) | elong-ation (%) |
| 8064 | ⊙ | ○ | 131 | ○ | 746 | 17 |
| 8065 | ⊙ | ○ | 133 | ○ | 652 | 19 |
| 8066 | ⊙ | ○ | 130 | ○ | 758 | 19 |
| 8067 | ⊙ | ○ | 129 | ○ | 734 | 19 |
| 8068 | ⊙ | ○ | 131 | ○ | 710 | 17 |
| 8069 | ⊙ | ○ | 131 | ○ | 767 | 20 |
| 8070 | ⊙ | ○ | 131 | ○ | 753 | 18 |

TABLE 50

| | machinability | | | hot work-ability | mechanical properties | |
|---|---|---|---|---|---|---|
| No. | form of chippings | condition of cut surface | cutting force (N) | 700° C. deform-ability | tensile strength (N/mm$^2$) | elong-ation (%) |
| 8092 | ⊙ | ○ | 130 | ○ | 680 | 22 |
| 8093 | ⊙ | ○ | 131 | ○ | 655 | 23 |
| 8094 | ⊙ | ○ | 128 | ○ | 714 | 21 |
| 8095 | ⊙ | ○ | 132 | ○ | 638 | 24 |
| 8096 | ⊙ | ○ | 128 | ○ | 689 | 22 |
| 8097 | ⊙ | ○ | 129 | ○ | 711 | 21 |
| 8098 | ⊙ | ○ | 130 | ○ | 693 | 20 |
| 8099 | ⊙ | ○ | 127 | ○ | 702 | 21 |
| 8100 | ⊙ | ○ | 129 | ○ | 724 | 18 |

TABLE 51

| | machinability | | | hot work-ability | mechanical properties | |
|---|---|---|---|---|---|---|
| No. | form of chippings | condition of cut surface | cutting force (N) | 700° C. deform-ability | tensile strength (N/mm$^2$) | elong-ation (%) |
| 8101 | ⊙ | ○ | 131 | ○ | 685 | 18 |
| 8102 | ⊙ | ○ | 132 | ○ | 690 | 21 |

TABLE 51-continued

| No. | machinability: form of chippings | machinability: condition of cut surface | machinability: cutting force (N) | hot work-ability: 700° C. deform-ability | mechanical properties: tensile strength (N/mm$^2$) | mechanical properties: elong-ation (%) |
|---|---|---|---|---|---|---|
| 8103 | ⊙ | ○ | 133 | ○ | 744 | 17 |
| 8104 | ⊙ | ○ | 130 | ○ | 726 | 17 |
| 8105 | ⊙ | ○ | 133 | ○ | 751 | 19 |
| 8113 | ⊙ | ○ | 129 | ○ | 745 | 22 |
| 8114 | ⊙ | ○ | 132 | ○ | 722 | 20 |
| 8115 | ⊙ | ○ | 130 | ○ | 706 | 17 |
| 8116 | ⊙ | ○ | 133 | ○ | 684 | 19 |
| 8117 | ⊙ | ○ | 132 | ○ | 740 | 18 |
| 8118 | ⊙ | ○ | 133 | ○ | 765 | 16 |
| 8119 | ⊙ | ○ | 128 | ○ | 733 | 22 |

TABLE 52

| No. | machinability: form of chippings | machinability: condition of cut surface | machinability: cutting force (N) | hot work-ability: 700° C. deform-ability | mechanical properties: tensile strength (N/mm$^2$) | mechanical properties: elong-ation (%) |
|---|---|---|---|---|---|---|
| 8141 | ⊙ | ○ | 131 | ○ | 687 | 22 |
| 8142 | ⊙ | ○ | 130 | ○ | 635 | 20 |
| 8143 | ⊙ | ○ | 129 | ○ | 710 | 23 |
| 8144 | ⊙ | ○ | 130 | ○ | 662 | 24 |
| 8145 | ⊙ | ○ | 128 | ○ | 728 | 23 |
| 8146 | ⊙ | ○ | 129 | ○ | 753 | 21 |
| 8147 | ⊙ | ○ | 130 | ○ | 709 | 24 |

TABLE 53

| No. | machinability: form of chippings | machinability: condition of cut surface | machinability: cutting force (N) | corrosion resistance: maximum depth of corrosion (μm) | hot workability: 700° C. deform ability | mechanical properties: tensile strength (N/mm$^2$) | mechanical properties: elongation (%) | stress resistance: corrosion cracking resistance | high-temperature oxidation: increase in weight by oxidation (mg/10 cm$^2$) |
|---|---|---|---|---|---|---|---|---|---|
| 9001 | ⊙ | Δ | 132 | 20 | ○ | 500 | 37 | ○ | 0.3 |
| 9002 | ⊙ | ○ | 122 | <5 | ○ | 564 | 35 | ○ | 0.2 |
| 9003 | ⊙ | ○ | 123 | <5 | ○ | 585 | 39 | ○ | 0.5 |
| 9004 | ⊙ | ○ | 118 | <5 | ○ | 558 | 34 | ○ | 0.2 |
| 9005 | Δ | ○ | 132 | <5 | Δ | 593 | 37 | ○ | 0.3 |

TABLE 54

| No. | machinability: form of chippings | machinability: condition of cut surface | machinability: cutting force (N) | corrosion resistance: maximum depth of corrosion (μm) | hot workability: 700° C. deform ability | mechanical properties: tensile strength (N/mm$^2$) | mechanical properties: elongation (%) | stress resistance: corrosion cracking resistance | high-temperature oxidation: increase in weight by oxidation (mg/10 cm$^2$) |
|---|---|---|---|---|---|---|---|---|---|
| 10001 | ⊙ | ○ | 124 | <5 | ○ | 534 | 35 | ○ | 0.3 |
| 10002 | ⊙ | ○ | 120 | <5 | ○ | 540 | 33 | ○ | 0.2 |
| 10003 | ⊙ | ○ | 122 | <5 | ○ | 539 | 38 | ○ | 0.2 |
| 10004 | ⊙ | ○ | 124 | <5 | ○ | 575 | 40 | ○ | 0.1 |
| 10005 | ⊙ | Δ | 128 | <5 | ○ | 512 | 33 | ○ | 0.1 |
| 10006 | ⊙ | ○ | 120 | 20 | ○ | 560 | 35 | ○ | 0.1 |
| 10007 | ⊙ | ○ | 119 | <5 | ○ | 536 | 36 | ○ | 0.3 |
| 10008 | Δ | ○ | 132 | <5 | ○ | 501 | 31 | Δ | 0.1 |

TABLE 55

| No. | machinability: form of chippings | machinability: condition of cut surface | machinability: cutting force (N) | corrosion resistance: maximum depth of corrosion (μm) | hot: workability 700° C. deform ability | mechanical properties: tensile strength (N/mm²) | mechanical properties: elongation (%) | stress resistance: corrosion cracking resistance | high-temperature oxidation: increase in weight by oxidation (mg/10 cm²) |
|---|---|---|---|---|---|---|---|---|---|
| 11001 | ◎ | ○ | 117 | <5 | ○ | 540 | 36 | ○ | 0.2 |
| 11002 | ◎ | ○ | 117 | <5 | ○ | 537 | 34 | ○ | 0.3 |
| 11003 | ◎ | ○ | 121 | <5 | Δ | 573 | 38 | ○ | 0.2 |
| 11004 | ◎ | ○ | 119 | 30 | ○ | 512 | 30 | ○ | 0.3 |
| 11005 | ○ | ○ | 114 | <5 | Δ | 518 | 30 | ○ | 0.4 |
| 11006 | ◎ | ○ | 118 | <5 | ○ | 535 | 32 | ○ | 0.3 |
| 11007 | ◎ | ○ | 119 | <5 | Δ | 586 | 37 | ○ | 0.2 |

TABLE 56

| No. | machinability: form of chippings | machinability: condition of cut surface | machinability: cutting force (N) | corrosion resistance: maximum depth of corrosion (μm) | hot: workability 700° C. deform ability | mechanical properties: tensile strength (N/mm²) | mechanical properties: elongation (%) | stress resistance: corrosion cracking resistance | high-temperature oxidation: increase in weight by oxidation (mg/10 cm²) |
|---|---|---|---|---|---|---|---|---|---|
| 12001 | ◎ | ○ | 121 | <5 | ○ | 512 | 32 | ○ | 0.2 |
| 12002 | ◎ | ○ | 119 | <5 | ○ | 544 | 36 | ○ | 0.2 |
| 12003 | ◎ | ○ | 123 | <5 | ○ | 570 | 38 | ○ | 0.1 |
| 12004 | ◎ | ○ | 124 | <5 | Δ | 495 | 31 | ○ | 0.2 |
| 12005 | ◎ | ○ | 123 | 30 | Δ | 583 | 32 | Δ | 0.3 |
| 12006 | ◎ | ○ | 118 | <5 | ○ | 537 | 33 | ○ | 0.2 |
| 12007 | ◎ | ○ | 118 | 20 | ○ | 516 | 30 | ○ | 0.2 |
| 12008 | ◎ | ○ | 117 | <5 | ○ | 543 | 38 | ○ | 0.1 |
| 12009 | ◎ | ○ | 122 | 20 | ○ | 501 | 32 | ○ | 0.2 |
| 12010 | ◎ | ○ | 119 | 30 | ○ | 546 | 35 | ○ | 0.2 |
| 12011 | ◎ | ○ | 121 | 20 | ○ | 516 | 31 | ○ | 0.1 |
| 12012 | ◎ | ○ | 117 | <5 | ○ | 539 | 33 | ○ | 0.2 |
| 12012 | ◎ | ○ | 121 | <5 | ○ | 544 | 33 | ○ | <0.1 |
| 12014 | ◎ | ○ | 121 | <5 | Δ | 590 | 37 | ○ | <0.1 |
| 12015 | ◎ | ○ | 120 | 20 | ○ | 528 | 32 | ○ | 0.1 |
| 12016 | ◎ | ○ | 117 | <5 | ○ | 535 | 33 | ○ | 0.1 |
| 12017 | ◎ | ○ | 121 | <5 | ○ | 577 | 35 | ○ | 0.2 |
| 12018 | ◎ | ○ | 120 | <5 | Δ | 586 | 37 | ○ | 0.1 |
| 12019 | ◎ | ○ | 115 | <5 | ○ | 520 | 31 | ○ | 0.2 |
| 12020 | ◎ | ○ | 118 | <5 | ○ | 549 | 34 | ○ | 0.1 |
| 12021 | ◎ | ○ | 116 | <5 | ○ | 533 | 34 | ○ | 0.1 |

TABLE 57

| No. | machinability: form of chippings | machinability: condition of cut surface | machinability: cutting force (N) | corrosion resistance: maximum depth of corrosion (∞m) | hot: workability 700° C. deform ability | mechanical properties: tensile strength (N/mm²) | mechanical properties: elongation (%) | stress resistance: corrosion cracking resistance |
|---|---|---|---|---|---|---|---|---|
| 13001 | ◎ | ○ | 128 | 140 | Δ | 521 | 39 | ○ |
| 13002 | ◎ | ○ | 126 | 130 | Δ | 524 | 41 | ○ |
| 13003 | ◎ | ○ | 127 | 150 | Δ | 500 | 38 | ○ |
| 13004 | ◎ | ○ | 127 | 160 | Δ | 508 | 38 | ○ |
| 13005 | ◎ | ○ | 128 | 180 | ○ | 483 | 35 | ○ |
| 13006 | ◎ | ○ | 129 | 170 | ○ | 488 | 37 | ○ |

TABLE 58

| No. | machinability: form of chippings | machinability: condition of cut surface | machinability: cutting force (N) | corrosion resistance: maximum depth of corrosion (μm) | hot: workability 700° C. deform ability | mechanical properties: tensile strength (N/mm²) | mechanical properties: elongation (%) | stress resistance: corrosion cracking resistance | high-temperature oxidation: increase in weight by oxidation (mg/10 cm²) |
|---|---|---|---|---|---|---|---|---|---|
| 14001 | ○ | ○ | 103 | 1100 | Δ | 408 | 37 | x x | 1.8 |
| 14002 | ○ | ○ | 101 | 1000 | x | 387 | 39 | x x | 1.7 |

TABLE 58-continued

| | machinability | | | corrosion resistance | hot | mechanical properties | | stress resistance | high-temperature oxidation |
|---|---|---|---|---|---|---|---|---|---|
| No. | form of chippings | condition of cut surface | cutting force (N) | maximum depth of corrosion (μm) | workability 700° C. deform ability | tensile strength (N/mm$^2$) | elongation (%) | corrosion cracking resistance | increase in weight by oxidation (mg/10 cm$^2$) |
| 14003 | ○ | Δ | 112 | 1050 | ○ | 414 | 38 | x x | 1.7 |
| 14004 | x | ○ | 223 | 900 | ○ | 438 | 38 | x | 1.2 |
| 14005 | x | ○ | 178 | 350 | Δ | 735 | 28 | ○ | 0.2 |

TABLE 59

| No. | wear resistance weight loss by wear (mg/100000 rot.) |
|---|---|
| 7001a | 1.3 |
| 7002a | 0.8 |
| 7003a | 0.9 |
| 7016a | 1.3 |
| 7017a | 1.6 |
| 7018a | 1.4 |
| 7019a | 1.9 |
| 7020a | 1.5 |

TABLE 60

| No. | wear resistance weight loss by wear (mg/100000 rot.) |
|---|---|
| 7021a | 1.3 |
| 7030a | 1.4 |

TABLE 61

| No. | wear resistance weight loss by wear (mg/100000 rot.) |
|---|---|
| 8001a | 1.4 |
| 8002a | 1.1 |
| 8003a | 0.9 |
| 8004a | 1.2 |
| 8005a | 1.8 |
| 8006a | 1.3 |
| 8007a | 1.5 |
| 8015a | 1.5 |
| 8016a | 0.9 |
| 8017a | 1.4 |
| 8018a | 0.9 |
| 8019a | 1 |
| 8020a | 1.5 |

TABLE 62

| No. | wear resistance weight loss by wear (mg/100000 rot.) |
|---|---|
| 8021a | 1 |

TABLE 63

| No. | wear resistance weight loss by wear (mg/100000 rot.) |
|---|---|
| 8043a | 1.6 |
| 8044a | 1.2 |
| 8045a | 1 |
| 8046a | 2 |
| 8047a | 1.6 |
| 8048a | 1.7 |
| 8049a | 1.3 |
| 8050a | 1.5 |
| 8051a | 1 |
| 8052a | 1.5 |
| 8053a | 1.3 |
| 8054a | 1.2 |
| 8055a | 0.7 |
| 8056a | 0.9 |

TABLE 64

| No. | wear resistance weight loss by wear (mg/100000 rot.) |
|---|---|
| 8064a | 1.7 |
| 8065a | 2 |
| 8066a | 1.4 |
| 8067a | 1.5 |
| 8068a | 1.2 |
| 8069a | 0.9 |
| 8070a | 1 |

TABLE 65

| No. | wear resistance weight loss by wear (mg/100000 rot.) |
|---|---|
| 8092a | 1.6 |
| 8093a | 21 |
| 8094a | 1.5 |
| 8095a | 1.9 |
| 8096a | 1.5 |
| 8097a | 1.5 |
| 8098a | 1.4 |
| 8099a | 1.1 |
| 8100a | 0.9 |

TABLE 66

| No. | wear resistance weight loss by wear (mg/100000 rot.) |
|---|---|
| 8101a | 1.4 |
| 8102a | 1.3 |
| 8103a | 0.8 |
| 8104a | 0.8 |
| 8105a | 0.7 |
| 8113a | 0.9 |
| 8114a | 1.2 |
| 8115a | 1.1 |
| 8116a | 1.4 |
| 8117a | 1.1 |
| 8118a | 0.9 |
| 8119a | 1.1 |

TABLE 67

| No. | wear resistance weight loss by wear (mg/100000 rot.) |
|---|---|
| 8141a | 1.4 |
| 8142a | 1.8 |
| 8143a | 1.6 |
| 8144a | 1.9 |
| 8145a | 1.1 |
| 8146a | 1.2 |
| 8147a | 1.4 |

TABLE 68

| No. | wear resistance weight loss by wear (mg/100000 rot.) |
|---|---|
| 14001a | 500 |
| 14002a | 620 |
| 14003a | 520 |
| 14004a | 450 |
| 14005a | 25 |

What is claimed is:

1. A lead-free free-cutting copper alloy, consisting essentially of 69 to 79 percent, by weight, of copper; from 3.0 up to and including 4.0 percent, by weight, of silicon; and the remaining percent, by weight, of zinc, wherein the percent by weight of copper and silicon in the copper alloy satisfy the relationship $$55 \leqq X-3Y \leqq 70,$$

wherein

X is the percent, by weight, of copper, and

Y is the percent, by weight, of silicon; and the copper alloy has a metal construction comprising multiple phases integrated to form a composite phase, wherein the composite phase is an α phase matrix having a total phase area comprising not more than 5% of a β phase, and 5–70% of the total phase area is provided by at least one phase selected from the group consisting of a γ phase, a κ phase, and a $\mu$ phase.

2. A lead-free free-cutting copper alloy, consisting essentially of 69 to 79 percent, by weight, of copper; from 3.0 up to and including 4.0 percent, by weight, of silicon; at least one element selected from among 0.02 to 0.4 percent, by weight, of bismuth, 0.02 to 0.4 percent, by weight, of tellurium, and 0.02 to 0.4 percent, by weight, of selenium; and the remaining percent, by weight, of zinc, wherein the percent by weight of copper and silicon in the copper alloy satisfy the relationship $$55 \leqq X-3Y \leqq 70,$$

wherein

X is the percent, by weight, of copper, and

Y is the percent, by weight, of silicon; and the copper alloy has a metal construction comprising multiple phases integrated to form a composite phase, wherein the composite phase is an α phase matrix having a total phase area comprising not more than 5% of a β phase, and 5–70% of the total phase area is provided by at least one phase selected from the group consisting of a γ phase, a κ phase, and a $\mu$ phase.

3. A lead-free free-cutting copper alloy, consisting essentially of 70 to 80 percent, by weight, of copper; 1.8 to 3.5 percent, by weight, of silicon; at least one element selected from among 0.3 to 3.5 percent, by weight, of tin, and 0.02 to 0.25 percent, by weight, of phosphorus; and the remaining percent, by weight, of zinc, wherein the percent by weight of copper, silicon, tin and phosphorus in the copper alloy satisfy the relationship $$55 \leqq X-3Y+aZ+bW \leqq 70,$$

wherein

X is the percent, by weight, of copper,

Y is the percent, by weight, of silicon,

Z is the percent, by weight, of tin,

W is the percent, by weight, of phosphorus, a is −0.5, and b is −3; and the copper alloy has a metal construction comprising multiple phases integrated to form a composite phase, wherein the composite phase is an α phase matrix having a total phase area comprising not more than 5% of a β phase, and 5–70% of the total phase area is provided by at least one phase selected from the group consisting of a γ phase, a κ phase, and a $\mu$ phase.

4. A lead-free free-cutting copper alloy, consisting essentially of 70 to 80 percent, by weight, of copper; 1.8 to 3.5 percent, by weight, of silicon; at least one element selected from among 0.3 to 3.5 percent, by weight, of tin, and 0.02 to 0.25 percent, by weight, of phosphorus; at least one element selected from among 0.02 to 0.4 percent, by weight, of bismuth, 0.02 to 0.4 percent, by weight, of tellurium, and 0.02 to 0.4 percent, by weight, of selenium; and the remaining percent, by weight, of zinc, wherein the percent by weight of copper, silicon, tin and phosphorus in the copper alloy satisfy the relationship $$55 \leqq X-3Y+aZ+bW \leqq 70,$$

wherein

X is the percent, by weight, of copper,

Y is the percent, by weight, of silicon,

Z is the percent, by weight, of tin,

W is the percent, by weight, of phosphorus, a is −0.5, and b is −3; and the copper alloy has a metal construction comprising multiple phases integrated to form a composite phase, wherein the composite phase is an α phase matrix having a total phase area comprising not more than 5% of a β phase, and 5–70% of the total phase area is provided by at least one phase selected from the group consisting of a γ phase, a κ phase, and a μ phase.

5. A lead-free free-cutting copper alloy, consisting essentially of 69 to 79 percent, by weight, of copper; 2.0 to 4.0 percent, by weight, of silicon; at least one element selected from the group consisting of 0.3 to 3.5 percent, by weight, of tin, and 0.02 to 0.25 percent, by weight, of phosphorus; at least one element selected from the group consisting of 0.02 to 0.15 percent, by weight, of antimony, and 0.02 to 0.15 percent, by weight, of arsenic; and the remaining percent, by weight, of zinc, wherein the percent by weight of copper, silicon, tin and phosphorus in the copper alloy satisfy the relationship $$55 \leqq X-3Y+aZ+bW \leqq 70,$$

wherein

X is the percent, by weight, of copper,

Y is the percent, by weight, of silicon,

Z is the percent, by weight, of tin,

W is the percent, by weight, of phosphorus, a is −0.5, and b is −3; and the copper alloy has a metal construction comprising multiple phases integrated to form a composite phase, wherein the composite phase is an α phase matrix having a total phase area comprising not more than 5% of a β phase, and 5–70% of the total phase area is provided by at least one phase selected from the group consisting of a γ phase, a κ phase, and a μ phase.

6. A lead-free free-cutting copper alloy, consisting essentially of 69 to 79 percent, by weight, of copper; 2.0 to 4.0 percent, by weight, of silicon; at least one element selected from the group consisting of 0.3 to 3.5 percent, by weight, of tin, and 0.02 to 0.25 percent, by weight, of phosphorus; at least one element selected from the group consisting of 0.02 to 0.15 percent, by weight, of antimony, and 0.02 to 0.15 percent, by weight, of arsenic; at least one element selected from among 0.02 to 0.4 percent, by weight, of bismuth, 0.02 to 0.4 percent, by weight, of tellurium, and 0.02 to 0.4 percent, by weight, of selenium; and the remaining percent, by weight, of zinc, wherein the percent by weight of copper, silicon, tin and phosphorus in the copper alloy satisfy the relationship $$55 \leqq X-3Y+aZ+bW \leqq 70,$$

wherein

X is the percent, by weight, of copper,

Y is the percent, by weight, of silicon,

Z is the percent, by weight, of tin,

W is the percent, by weight, of phosphorus, a is −0.5, and b is −3; and the copper alloy has a metal construction comprising multiple phases integrated to form a composite phase, wherein the composite phase is an α phase matrix having a total phase area comprising not more than 5% of a β phase, and 5–70% of the total phase area is provided by at least one phase selected from the group consisting of a γ phase, a κ phase, and a μ phase.

7. A lead-free free-cutting copper alloy, consisting essentially of 62 to 78 percent, by weight, of copper; 2.5 to 4.5 percent, by weight, of silicon; at least one element selected from among 0.3 to 3.0 percent, by weight, of tin, and 0.02 to 0.25 percent, by weight, of phosphorus; and at least one element selected from among 0.7 to 3.5 percent, by weight, of manganese and 0.7 to 3.5 percent, by weight, of nickel; and the remaining percent, by weight, of zinc, wherein the percent by weight of copper, silicon, tin, phosphorus, manganese and nickel in the copper alloy satisfy the relationship $$55 \leqq X-3Y+aZ+bW+cV+dU \leqq 70,$$

wherein

X is the percent, by weight, of copper,

Y is the percent, by weight, of silicon,

Z is the percent, by weight, of tin,

W is the percent, by weight, of phosphorus,

V is the percent, by weight, of manganese,

U is the percent, by weight, of nickel, a is −0.5, b is −3, c is 2.5, d is 2.5, and the percent by weith of silicon, manganese and nickel satisfy the relationship $$0.7 \leqq Y/(V+U) \leqq 6;$$

and the copper alloy has a metal construction comprising multiple phases integrated to form a composite phase, wherein the composite phase is an α phase matrix having a total phase area comprising not more than 5% of a β phase, and 5–70% of the total phase area is provided by at least one phase selected from the group consisting of a γ phase, a κ phase, and a μ phase.

8. A lead-free free-cutting copper alloy, consisting essentially of 62 to 78 percent, by weight, of copper; 2.5 to 4.5 percent, by weight, of silicon; at least one element selected from among 0.3 to 3.0 percent, by weight, of tin, and 0.02 to 0.25 percent, by weight, of phosphorus; and at least one element selected from among 0.7 to 3.5 percent, by weight, of manganese and 0.7 to 3.5 percent, by weight, of nickel; at least one element selected from among 0.02 to 0.4 percent, by weight, of bismuth, 0.02 to 0.4 percent, by weight, of tellurium, and 0.02 to 0.4 percent, by weight, of selenium; and the remaining percent, by weight, of zinc, wherein the percent by weight of copper, silicon, tin, phosphorus, manganese and nickel in the copper alloy satisfy the relationship $$55 \leqq X-3Y+aZ+bW+cV+dU \leqq 70,$$

wherein

X is the percent, by weight, of copper,

Y is the percent, by weight, of silicon,

Z is the percent, by weight, of tin,

W is the percent, by weight, of phosphorus,

V is the percent, by weight, of manganese,

U is the percent, by weight, of nickel, a is −0.5, b is −3, c is 2.5, d is 2.5, and the percent by weith of silicon, manganese and nickel satisfy the relationship $$0.7 \leqq Y/(V+U) \leqq 6;$$

and the copper alloy has a metal construction comprising multiple phases integrated to form a composite phase, wherein the composite phase is an α phase matrix having a total phase area comprising not more than 5% of a β phase, and 5–70% of the total phase area is provided by at least one phase selected from the group consisting of a γ phase, a κ phase, and a μ phase.

9. A lead-free free-cutting copper alloy, consisting essentially of 69 to 79 percent, by weight, of copper; 2.0 to 4.0 percent, by weight, of silicon; 0.1 to 1.5 percent, by weight, of aluminum; and 0.02 to 0.25 percent, by weight, of phosphorus; and the remaining percent, by weight, of zinc, wherein the percent by weight of copper, silicon, aluminum and phosphorus in the copper alloy satisfy the relationship $$55 \leqq X-3Y+aZ+bW \leqq 70,$$

wherein

X is the percent, by weight, of copper,

Y is the percent, by weight, of silicon,

Z is the percent, by weight, of aluminum,

W is the percent, by weight, of phosphorus, a is −2, and b is −3; and the copper alloy has a metal construction comprising multiple phases integrated to form a composite phase, wherein the composite phase is an α phase matrix having a total phase area comprising not more than 5% of a β phase, and 5–70% of the total phase area is provided by at least one phase selected from the group consisting of a γ phase, a κ phase, and a μ phase.

10. A lead-free free-cutting copper alloy, consisting essentially of 69 to 79 percent, by weight, of copper; 2.0 to 4.0 percent, by weight, of silicon; 0.1 to 1.5 percent, by weight, of aluminum; 0.02 to 0.25 percent, by weight, of phosphorus; at least one element selected from among 0.02 to 0.4 percent, by weight, of chromium and 0.02 to 0.4 percent, by weight, of titanium; and the remaining percent, by weight, of zinc, wherein the percent by weight of copper, silicon, aluminum, phosphorus and chromium in the copper alloy satisfy the relationship $$55 \leqq X-3Y+aZ+bW+cV \leqq 70,$$

wherein

X is the percent, by weight, of copper,

Y is the percent, by weight, of silicon,

Z is the percent, by weight, of aluminum,

W is the percent, by weight, of phosphorus,

V is the percent, by weight, of chromium, a is −2, b is −3, c is 2; and the copper alloy has a metal construction comprising multiple phases integrated to form a composite phase, wherein the composite phase is an α phase matrix having a total phase area comprising not more than 5% of a β phase, and 5–70% of the total phase area is provided by at least one phase selected from the group consisting of a γ phase, a κ phase, and a μ phase.

11. A lead-free free-cutting copper alloy, consisting essentially of 69 to 79 percent, by weight, of copper; 2.0 to 4.0 percent, by weight, of silicon; 0.1 to 1.5 percent, by weight, of aluminum; 0.02 to 0.25 percent, by weight, of phosphorus; at least one element selected from among 0.02 to 0.4 percent, by weight, of bismuth, 0.02 to 0.4 percent, by weight, of tellurium and 0.02 to 0.4 percent, by weight, of selenium; and the remaining percent, by weight, of zinc, wherein the percent by weight of copper, silicon, tin and phosphorus in the copper alloy satisfy the relationship $$55 \leqq X-3Y+aZ+bW \leqq 70,$$

wherein

X is the percent, by weight, of copper,

Y is the percent, by weight, of silicon,

Z is the percent, by weight, of aluminum,

W is the percent, by weight, of phosphorus, a is −2, and b is −3; and the copper alloy has a metal construction comprising multiple phases integrated to form a composite phase, wherein the composite phase is an α phase matrix having a total phase area comprising not more than 5% of a β phase, and 5–70% of the total phase area is provided by at least one phase selected from the group consisting of a γ phase, a κ phase, and a μ phase.

12. A lead-free free-cutting copper alloy, consisting essentially of 69 to 79 percent, by weight, of copper; 2.0 to 4.0 percent, by weight, of silicon; 0.1 to 1.5 percent, by weight, of aluminum; 0.02 to 0.25 percent, by weight, of phosphorus; at least one element selected from among 0.02 to 0.4 percent, by weight, of chromium, and 0.02 to 0.4 percent by weight of titanium; at least one element selected from among 0.02 to 0.4 percent, by weight, of bismuth, 0.02 to 0.4 percent, by weight, of tellurium and 0.02 to 0.4 percent, by weight, of selenium; and the remaining percent, by weight, of zinc, wherein the percent by weight of copper, silicon, aluminum, phosphorus and chromium in the copper alloy satisfy the relationship $$55 \leqq X-3Y+aZ+bW+cV \leqq 70,$$

wherein

X is the percent, by weight, of copper,

Y is the percent, by weight, of silicon,

Z is the percent, by weight, of aluminum,

W is the percent, by weight, of phosphorus,

V is the percent, by weight, of chromium, a is −2, b is −3, c is 2; and the copper alloy has a metal construction comprising multiple phases integrated to form a composite phase, wherein the composite phase is an α phase matrix having a total phase area comprising not more than 5% of a β phase, and 5–70% of the total phase area is provided by at least one phase selected from the group consisting of a γ phase, a κ phase, and a μ phase.

* * * * *